US006423204B1

(12) United States Patent
Ray et al.

(10) Patent No.: US 6,423,204 B1
(45) **Date of Patent: *Jul. 23, 2002**

(54) FOR CERMET INERT ANODE CONTAINING OXIDE AND METAL PHASES USEFUL FOR THE ELECTOLYTIC PRODUCTION OF METALS

(75) Inventors: Siba P. Ray, Murrysville; Xinghua Liu, Monroeville; Douglas A. Weirauch, Murrysville, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/629,332

(22) Filed: Aug. 1, 2000

Related U.S. Application Data

(63) Continuation-in-part of application No. 09/542,318, filed on Apr. 4, 2000, and a continuation-in-part of application No. 09/542,320, filed on Apr. 4, 2000, now Pat. No. 6,372,119, which is a continuation-in-part of application No. 09/431,756, filed on Nov. 1, 1999, now Pat. No. 6,217,739, which is a continuation-in-part of application No. 09/428,004, filed on Oct. 27, 1999, now Pat. No. 6,162,334, which is a continuation-in-part of application No. 09/241,518, filed on Feb. 1, 1999, now Pat. No. 6,126,799, which is a continuation-in-part of application No. 08/883,061, filed on Jun. 26, 1997, now Pat. No. 5,865,980.

(51) Int. Cl.[7] ..... C25C 3/08

(52) U.S. Cl. ..... 205/387; 205/372; 205/380; 205/385; 204/243.1; 204/247.3; 204/291; 204/292; 204/293

(58) Field of Search ..... 204/291, 292, 204/293, 243.1, 247.3; 205/372, 380, 385, 387

(56) References Cited

U.S. PATENT DOCUMENTS

| | | | | |
|---|---|---|---|---|
| 3,996,117 | A | 12/1976 | Graham et al. | 204/67 |
| 4,190,516 | A | 2/1980 | Kajimaya et al. | 204/290 R |
| 4,288,302 | A | 9/1981 | de Nora et al. | 204/105 |
| 4,290,859 | A | 9/1981 | Oda et al. | 204/16 |
| 4,374,050 | A | 2/1983 | Ray | 252/519 |
| 4,374,761 | A | 2/1983 | Ray | 252/519 |
| 4,397,729 | A | 8/1983 | Deruz et al. | 204/243 |
| 4,399,008 | A | 8/1983 | Ray | 204/67 |
| 4,455,211 | A | 6/1984 | Ray et al. | 204/293 |
| 4,462,889 | A | 7/1984 | Landon et al. | 204/292 |
| 4,472,258 | A | 9/1984 | Secrist et al. | 204/292 |
| 4,552,630 | A | 11/1985 | Wheeler et al. | 204/67 |
| 4,582,585 | A | 4/1986 | Ray | 204/243 |
| 4,584,172 | A | 4/1986 | Ray et al. | 419/34 |
| 4,620,905 | A | 11/1986 | Tarcy et al. | 204/64 R |
| 4,871,437 | A | 10/1989 | Marschman et al. | 204/291 |
| 4,871,438 | A | 10/1989 | Marschman et al. | 204/291 |
| 4,960,494 | A | 10/1990 | Nguyen et al. | 204/67 |
| 5,019,225 | A | 5/1991 | Darracq et al. | 204/67 |
| 5,137,867 | A | 8/1992 | Ray et al. | 505/1 |
| 5,254,232 | A | 10/1993 | Sadoway | 204/243 |
| 5,279,715 | A | 1/1994 | LaCamera et al. | 204/64 |
| 5,284,562 | A | 2/1994 | Beck et al. | 204/243 |
| 5,378,325 | A | 1/1995 | Dastolfo, Jr. et al. | 204/66 |
| 5,626,914 | A | 5/1997 | Ritland et al. | 427/377 |
| 5,794,112 | A | 8/1998 | Ray et al. | 419/21 |
| 5,865,980 | A | 2/1999 | Ray et al. | 205/367 |
| 5,904,828 | A | 5/1999 | Sekhar et al. | 205/188 |
| 5,938,914 | A | 8/1999 | Dawless et al. | 205/391 |
| 6,162,334 | A | 12/1999 | Ray et al. | 204/290.14 |
| 6,030,518 | A | 2/2000 | Dawless et al. | 205/387 |
| 6,077,415 | A | 6/2000 | Duruz et al. | 205/384 |
| 6,113,758 | A | 9/2000 | de Nora et al. | 204/284 |
| 6,126,799 | A | * 10/2000 | Ray et al. | 204/293 |

FOREIGN PATENT DOCUMENTS

| | | |
|---|---|---|
| WO | 9935694 | 7/1999 |
| WO | 0044953 | 11/2000 |

OTHER PUBLICATIONS

Belyaev, "Electrolysis of Aluminum with Nonburning Ferrite Anodes", *Legkie Metal*, 7(1):7–20, 1938. No month available.

Billehaug Et Al., "Inert Anodes for Aluminum Electrolysis in Hall–Héroult Cells (I)", *Aluminum*, pp. 146–150, 1981. No month available.

Billehaug Et Al., "Inert Anodes for Aluminum Electrolysis in Hall–Héroult Cells (II)", *Aluminum*, pp. 228–231, 1981. No month available.

* cited by examiner

*Primary Examiner*—Bruce F. Bell
(74) *Attorney, Agent, or Firm*—Alan G. Towner; Edward L. Levine

(57) ABSTRACT

A cermet inert anode for the electrolytic production of metals such as aluminum is disclosed. The inert anode comprises a ceramic phase including an oxide of Ni, Fe and M, where M is at least one metal selected from Zn, Co, Al, Li, Cu, Ti, V, Cr, Zr, Nb, Ta, W, Mo, Hf and rare earths, preferably Zn and/or Co. Preferred ceramic compositions comprise $Fe_2O_3$, NiO and ZnO or CoO. The cermet inert anode also comprises a metal phase such as Cu, Ag, Pd, Pt, Au, Rh, Ru, Ir and/or Os. A preferred metal phase comprises Cu and Ag. The cermet inert anodes may be used in electrolytic reduction cells for the production of commercial purity aluminum as well as other metals.

138 Claims, 11 Drawing Sheets

Y

Z X

FOR CERMET INERT ANODE CONTAINING OXIDE AND METAL PHASES USEFUL FOR THE ELECTOLYTIC PRODUCTION OF METALS

CROSS REFERENCE TO RELATED APPLICATIONS

This application is a continuation-in-part of U.S. Ser. No. 09/542,318 filed Apr. 4, 2000 and U.S. Ser. No. 09/542,320 filed Apr. 4, 2000, now U.S. Pat. No. 6,372,119, each of which is a continuation-in-part of U.S. Ser. No. 09/428,004 filed Oct. 27, 1999, now U.S. Pat. No. 6,162,334 issued Dec. 19, 2000, and U.S. Ser. No. 09/431,756 filed Nov. 1, 1999, now U.S. Pat. No. 6,217,739 issued Apr. 17, 2001, which are continuations in-part of U.S. Ser. No. 09/241,518 filed Feb. 1, 1999, now U.S. Pat. No. 6,126,799 issued Oct. 3, 2000, which is a continuation-in-part of U.S. Ser. No. 08/883,061 filed Jun. 26, 1997, now U.S. Pat. No. 5,865,980 issued Feb. 2, 1999, each of which is incorporated herein by reference.

GOVERNMENT CONTRACT

This invention was made with Government support under Contract No. DE-FC07-98ID13666 awarded by the Department of Energy. The Government has certain rights in this invention.

FIELD OF THE INVENTION

The present invention relates to the electrolytic production of metals such as aluminum. More particularly, the invention relates to electrolysis in a cell having a cermet inert anode comprising a ceramic phase and a metal phase.

BACKGROUND OF THE INVENTION

The energy and cost efficiency of aluminum smelting can be significantly reduced with the use of inert, non-consumable and dimensionally stable anodes. Replacement of traditional carbon anodes with inert anodes allows a highly productive cell design to be utilized, thereby reducing capital costs. Significant environmental benefits are also possible because inert anodes produce essentially no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,279,715, 5,794,112 and 5,865,980, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, e.g., about 900–1,000° C., so that the voltage drop at the anode is low.

In addition to the above-noted criteria, aluminum produced with the inert anodes should not be contaminated with constituents of the anode material to any appreciable extent. Although the use of inert anodes in aluminum electrolytic reduction cells has been proposed in the past, the use of such inert anodes has not been put into commercial practice. One reason for this lack of implementation has been the long-standing inability to produce aluminum of commercial grade purity with inert anodes. For example, impurity levels of Fe, Cu and/or Ni have been found to be unacceptably high in aluminum produced with known inert anode materials.

The present invention has been developed in view of the foregoing, and to address other deficiencies of the prior art.

SUMMARY OF THE INVENTION

The present invention provides an inert anode comprising a ceramic phase and a metal phase. The ceramic phase preferably comprises oxides of iron, nickel and at least one other metal such as zinc or cobalt. The metal phase preferably comprises at least one metal selected from Cu, Ag, Pd, Pt, Au, Rh, Ru, Ir and Os.

An aspect of the invention is to provide an inert anode composition suitable for usage in a molten salt bath. In one embodiment, the composition comprises at least one ceramic phase of the formula $Ni_xFe_{2y}M_zO_{(3y+x+z)\pm\delta}$, where M is at least one metal selected from Zn, Co, Al, Li, Cu, Ti, V, Cr, Zr, Nb, Ta, W, Mo, Hf and rare earths, x is from about 0.1 to about 0.99, y is from about 0.0001 to about 0.9, and z is from about 0.0001 to about 0.5. The oxygen stoichiometry may vary by a factor of δ which may range from 0 to 0.3. In this formula, the oxygen may be partially substituted with F and/or N. The cermet inert anode composition also includes at least one metal phase. A preferred metal phase includes Cu and/or Ag, and may also include at least one noble metal selected from Pd, Pt, Au, Rh, Ru, Ir and Os.

Another aspect of the invention is to provide a method of making a cermet inert anode composition. In one embodiment, the method includes the steps of mixing at least one metal with a ceramic material of the formula $Ni_xFe_{2y}M_zO_{(3y+x+z)\pm\delta}$, where M is at least one metal selected from Zn, Co, Al, Li, Cu, Ti, V, Cr, Zr, Nb, Ta, W, Mo, Hf and rare earths, x is from about 0.1 to about 0.99, y is from about 0.0001 to about 0.9, z is from about 0.0001 to about 0.5, and δ is from 0 to about 0.3, pressing the mixture, and sintering the mixture.

A further aspect of the invention is to provide an electrolytic cell for producing metal. The cell includes a molten salt bath comprising an electrolyte and an oxide of a metal to be collected, a cathode, and a cermet inert anode of the present invention.

Another aspect of the present invention is to provide a method of producing commercial purity aluminum, utilizing the cermet inert anode of the present invention.

Other aspects and advantages of the invention will occur to persons skilled in the art from the following detailed description.

DETAILED DESCRIPTION

Figure 1:
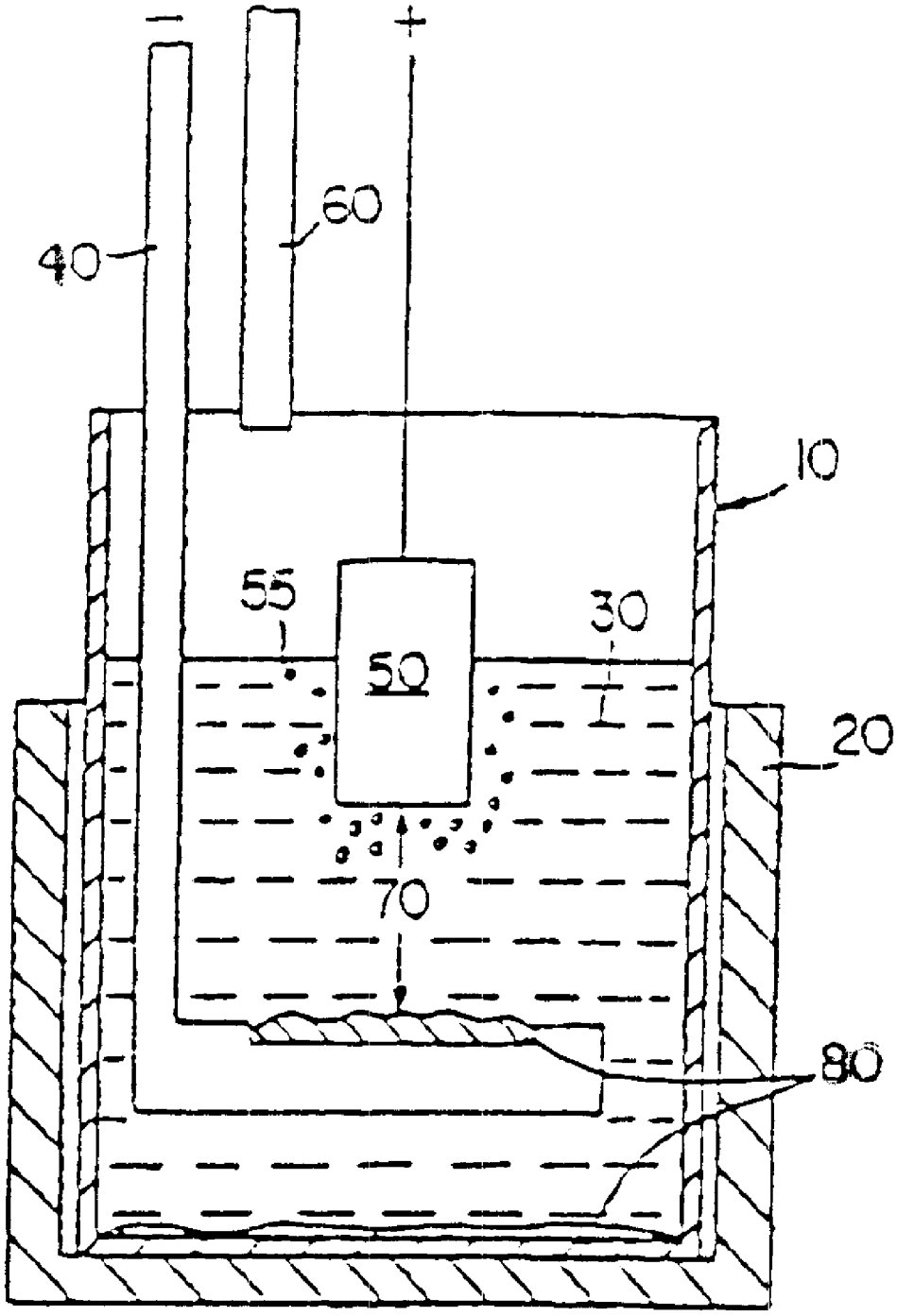
FIG. 1 is a partially schematic sectional view of an electrolytic cell for the production of aluminum including a cermet inert anode in accordance with an embodiment of the present invention.

FIG. 1 schematically illustrates an electrolytic cell for the production of aluminum which includes a cermet inert anode in accordance,with an embodiment of the present invention. The cell includes an inner crucible 10 inside a protection crucible 20. A cryolite bath 30 is contained in the inner crucible 10, and a cathode 40 is provided in the bath 30. A cermet inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Aluminum 80 produced during a run is deposited on the cathode 40 and on the bottom of the crucible 10. In addition to the production of aluminum, the cermet inert anodes of the invention may also be useful in producing other metals such as lead, magnesium, zinc, zirconium, titanium, lithium, calcium, silicon, barium, strontium, scandium, niobium, vanadium, tantalum, tin, germanium, indium, hafnium, molybdenum and the like, by electrolytic reduction of an oxide or other salt of the metal.

As used herein, the term "inert anode" means a substantially nonconsumable anode which possesses satisfactory corrosion resistance and stability during the aluminum production process. At least part of the inert anode comprises the cermet material of the present invention. For example, the inert anode may be made entirely of the present cermet material, or the inert anode may comprise an outer coating or layer of the cermet material over a central core. Where the cermet is provided as an outer coating, it preferably has a thickness of from 0.1 to 50 mm, more preferably from 1 to 10 or 20 mm.

The term "commercial purity aluminum" as used herein means aluminum which meets commercial purity standards upon production by an electrolytic reduction process. The commercial purity aluminum produced with the cermet inert anodes of the present invention preferably comprises a maximum of 0.2 weight percent Fe, 0.1 weight percent Cu, and 0.034 weight percent Ni. In a more preferred embodiment, the commercial purity aluminum comprises a maximum of 0.15 weight percent Fe, 0.034 weight percent Cu, and 0.03 weight percent Ni. In a particularly preferred embodiment, the commercial purity aluminum comprises a maximum of 0.13 weight percent Fe, 0.03 weight percent Cu, and 0.03 weight percent Ni. The commercial purity aluminum also preferably meets the following weight percentage standards for other types of impurities: 0.2 maximum Si, 0.03 maximum Zn, and 0.034 maximum Co. The Zn and Co impurity levels are more preferably kept below 0.03 weight percent for each impurity. The Si impurity level is more preferably kept below 0.15 or 0.10 weight percent.

The inert anode compositions of the present invention typically comprise from about 1 to about 99.9 weight percent of at least one ceramic phase and from about 0.1 to about 99 weight percent of at least one metal phase. The ceramic phase preferably comprises from about 50 to about 95 weight percent of the cermet material, and the metal phase comprises from about 5 to about 50 weight percent of the cermet. More preferably, the ceramic phase comprises from about 80 to about 90 weight percent of the cermet, and the metal phase comprises from about 10 to about 20 weight percent. It is noted that for every numerical range or limit set forth herein, all numbers within the range or limit including every fraction or decimal between its stated minimum and maximum, are considered to be designated and disclosed by this description.

The ceramic phase preferably comprises iron and nickel oxides, and at least one additional oxide such as zinc oxide and/or cobalt oxide. In one embodiment, the ceramic phase is preferably of the formula $Ni_xFe_{2y}M_zO_{(3y+x+z)\pm\delta}$, where M is at least one metal selected from Zn, Co, Al, Li, Cu, Ti, V, Cr, Zr, Nb, Ta, W, Mo, Hf and rare earths, preferably Zn and/or Co, x is from about 0.1 to about 0.99, y is from about 0.0001 to about 0.9, and z is from about 0.0001 to about 0.5. In the foregoing formula, the oxygen stoichiometry is not necessarily equal to 3y+x+z, but may change slightly up or down depending upon, e.g., firing conditions by a factor of δ. The value of δ may range from 0 to about 0.3, preferably from 0 to about 0.2.

In a preferred embodiment, the ceramic phase comprises iron, nickel and zinc oxide. In this embodiment, the ceramic phase comprises oxides of nickel, iron and zinc, and is of the formula $Ni_xFe_{2y}Zn_zO_{(3y+x+z)\pm\delta}$, where x is the molar amount of Ni, y is the molar amount of Fe, and z is the molar amount of Zn.

In this embodiment, the mole fraction of NiO typically ranges from about 0.2 to about 0.99, the mole fraction of $Fe_2O_3$ typically ranges from about 0.0001 to about 0.8, and the mole fraction of ZnO typically ranges from about 0.0001 to about 0.3. In a preferred composition, the mole fraction of NiO ranges from about 0.45 to about 0.8, the mole fraction of $Fe_2O_3$ ranges from about 0.05 to about 0.499, and the mole fraction of ZnO ranges from about 0.001 to about 0.26. In a more preferred composition, the mole fraction of NiO ranges from about 0.45 to about 0.65, the mole fraction of $Fe_2O_3$ ranges from about 0.2 to about 0.49, and the mole fraction of ZnO ranges from about 0.001 to about 0.22.

Table 1 lists the typical, preferred and more preferred mole fraction ranges of NiO, $Fe_2O_3$ and ZnO. The listed mole fractions may be multiplied by 100 to indicate mole percentages. Within these ranges, the solubility of the constituent oxides in an electrolyte bath is reduced significantly. Lower oxide solubility in the electrolyte bath is believed to improve the purity of the aluminum produced in the bath.

TABLE 1

Mole Fractions of NiO, $Fe_2O_3$ and ZnO

| | NiO | $Fe_2O_3$ | ZnO |
|---|---|---|---|
| Typical | 0.2–0.99 | 0.0001–0.8 | 0.0001–0.3 |
| Preferred | 0.45–0.8 | 0.05–0.499 | 0.001–0.26 |
| More Preferred | 0.45–0.65 | 0.2–0.49 | 0.001–0.22 |

Figure 2:
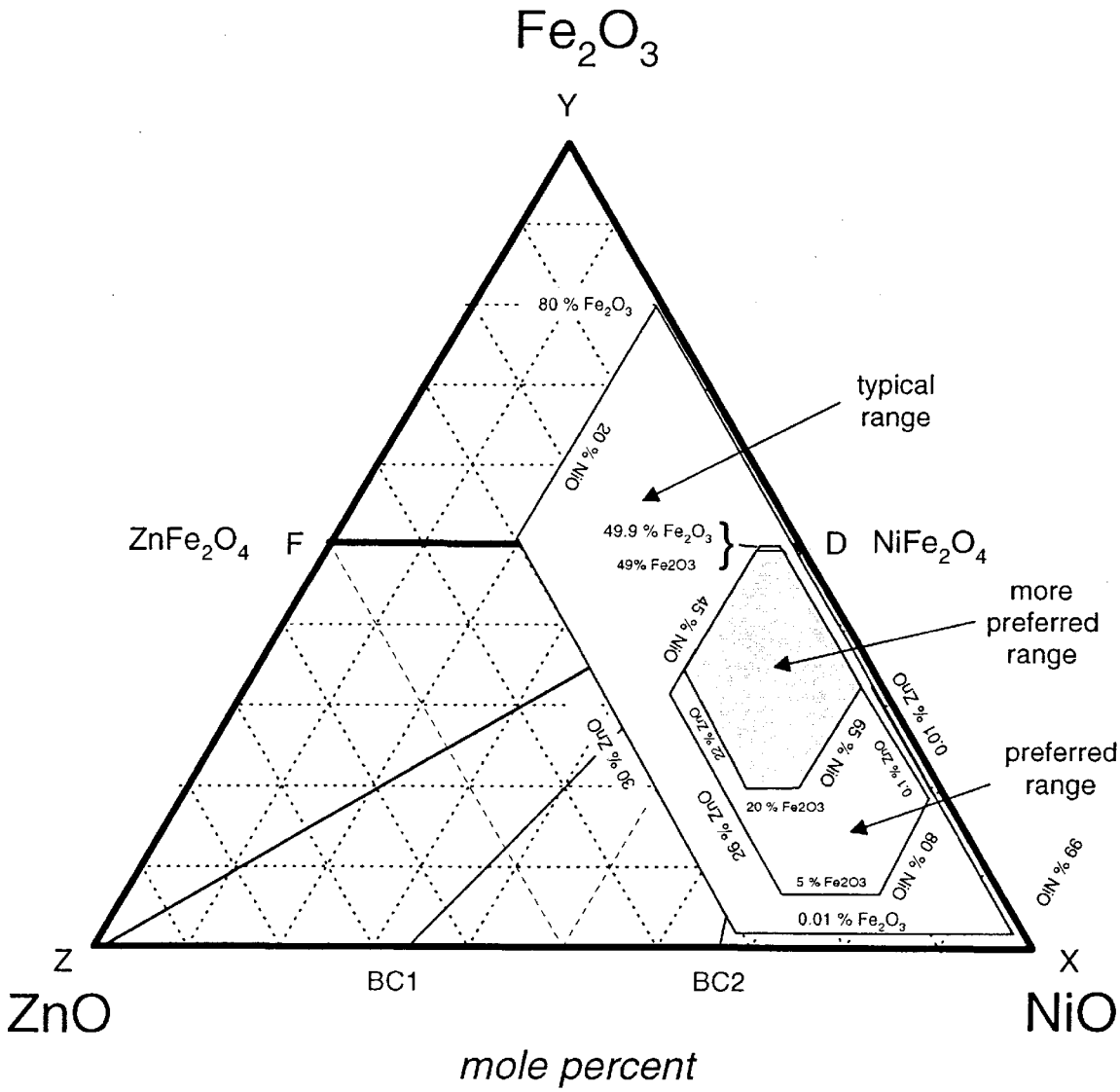
FIG. 2 is a ternary phase diagram illustrating ranges of nickel, iron and zinc oxides utilized in inert anode compositions in accordance with an embodiment of the present invention.

FIG. 2 is a ternary phase diagram illustrating, the typical, preferred and more preferred ranges of NiO, $Fe_2O_3$ and ZnO starting materials used to make inert anode compositions in accordance with this embodiment of the present invention. Although the mole percentages illustrated in FIG. 2 are based on NiO, $Fe_2O_3$ and ZnO starting materials, other nickel, iron, and zinc oxides, or compounds which form oxides upon calcination, may be used as starting materials.

Table 2 lists some ternary Ni—Fe—Zn—O materials that may be suitable for use as the ceramic phase of the present cermet inert anodes, as well as some comparison materials. In addition to the phases listed in Table 2, minor or trace amounts of other phases may be present.

TABLE 2

Ni—Fe—Zn—O Compositions

| Sample I. D. | Nominal Composition | Measured Elemental Weight Percent Fe, Ni, Zn | Structural Types (identified by XRD) |
|---|---|---|---|
| 5412 | $NiFe_2O_4$ | 48, 23.0, 0.15 | $NiFe_2O_4$ |
| 5324 | $NiFe_2O_4$ + NiO | 34, 36, 0.06 | $NiFe_2O_4$, NiO |
| E4 | $Zn_{0.05}Ni_{0.95}Fe_2O_4$ | 43, 22, 1.4 | $NiFe_2O_4$ |
| E3 | $Zn_{0.1}Ni_{0.9}Fe_2O_4$ | 43, 20, 2.7 | $NiFe_2O_4$ |
| E2 | $Zn_{0.25}Ni_{0.75}Fe_2O_4$ | 40, 15, 5.9 | $NiFe_2O_4$ |
| E1 | $Zn_{0.25}Ni_{0.75}Fe_{1.9}O_4$ | 45, 18, 7.8 | $NiFe_2O$ |
| E | $Zn_{0.5}Ni_{0.5}Fe_2O_4$ | 45, 12, 13 | $(ZnNi)Fe_2O_4$, $ZnO^S$ |
| F | $ZnFe_2O_4$ | 43, 0.03, 24 | $ZnFe_2O_4$, ZnO |
| H | $Zn_{0.5}NiFe_{1.5}O_4$ | 33, 23, 13 | $(ZnNi)Fe_2O_4$, $NiO^S$ |
| J | $Zn_{0.5}Ni_{1.5}FeO_4$ | 26, 39, 10 | $NiFe_2O_4$,NiO |
| L | $ZnNiFeO_4$ | 22, 23, 27 | $(ZnNi)Fe_2O_4$, $NiO^S$, ZnO |
| ZD6 | $Zn_{0.05}Ni_{1.05}Fe_{1.9}O_4$ | 40, 24, 1.3 | $NiFe_2O_4$ |
| ZD5 | $Zn_{0.1}Ni_{1.1}Fe_{1.8}O_4$ | 29, 18, 2.3 | $NiFe_2O_4$ |
| ZD3 | $Zn_{0.12}Ni_{0.94}Fe_{1.88}O_4$ | 43, 23, 3.2 | $NiFe_2O_4$ |
| ZD1 | $Zn_{0.5}Ni_{0.75}Fe_{1.5}O_4$ | 40, 20, 11 | $(ZnNi)Fe_2O_4$ |
| DH | $Zn_{0.18}Ni_{0.96}Fe_{1.8}O_4$ | 42, 23, 4.9 | $NiFe_2O_4$, NiO |
| DI | $Zn_{0.08}Ni_{1.17}Fe_{1.5}O_4$ | 38, 30, 2.4 | $NiFe_2O_4$, NiO |
| DJ | $Zn_{0.17}Ni_{1.1}Fe_{1.5}O_4$ | 36, 29, 4.8 | $NiFe_2O_4$, NiO |
| BC2 | $Zn_{0.33}Ni_{0.67}O$ | 0.11, 52, 25 | $NiO^S$ |

S means shifted peak.

Figure 3:
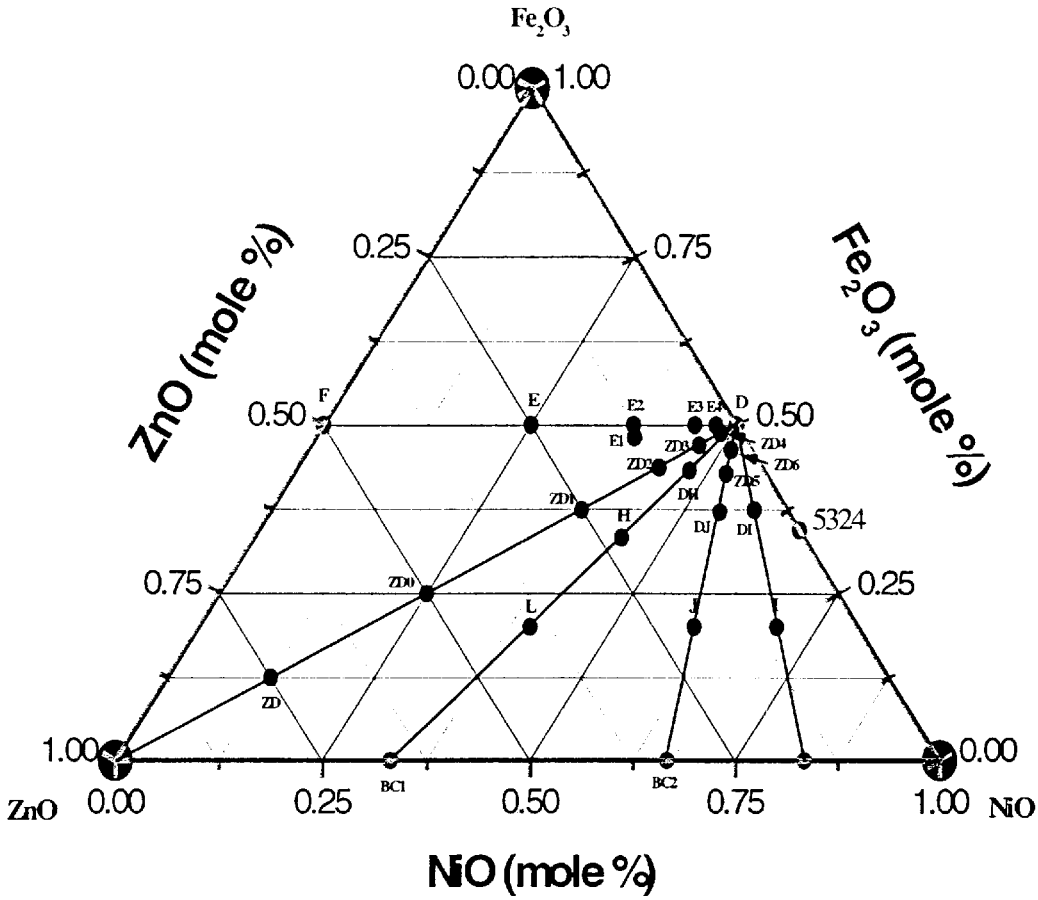
FIG. 3 is a ternary phase diagram indicating the amounts of nickel, iron and zinc oxides utilized in specific inert anode compositions in accordance with embodiments of the present invention.

FIG. 3 is a ternary phase diagram illustrating the amounts of NiO, $Fe_2O_3$ and ZnO starting materials used to make the compositions listed in Table 2, which may be used as the ceramic phase(s) of cermet inert anodes. Such inert anodes may in turn be used to produce commercial purity aluminum in accordance with the present invention.

The Ni—Fe—Zn—O compositions listed in Table 2 and shown in FIG. 3 may be prepared and tested as follows. Oxide powders may be synthesized by a wet chemical approach or traditional commercial methods. The starting chemicals include one or a mixture of oxides, chlorides, acetates, nitrates, tartarates, citrates and sulfates of Ni, Fe and Zn salts. Such precursors are commercially available from sources such as Aldrich and Fisher. A homogeneous solution may be prepared by dissolving the desired amounts of the chemicals into de-ionized water. The solution pH is adjusted to 6–9 by adding ammonium hydroxide while stirring. A pH of from 7 to 8 is preferred. The viscous solution is dried by oven, freeze dryer, spray dryer or the like. The resultant dried solid is amorphous. Crystalline oxide powders are obtained after calcination of the dried solid, e.g., at a temperature of from 600 to 800° C. for 2 hours. The oxide powders are then uniaxially or isostatically pressed to pellet form under a pressure of from 10,000 to 30,000 psi, typically 20,000 psi. The pressed pellets are sintered in air at a temperature of 1,000–1500° C., typically 1200° C., for 2–4 hours. The crystalline structure and the composition of the sintered oxide pellets may be analyzed by x-ray diffraction (XRD) and inductively-coupled plasma (ICP) techniques.

The solubilities of Ni—Fe—Zn—O ceramic phase compositions were tested. The solubility of each ceramic mixture was measured by holding approximately 3 g of sintered oxide pellets in 160 g of a standard cryolitic molten salt bath at 960° C. for 96 hours. The standard salt bath was contained in a platinum crucible and prepared by batching NaF, $AlF_3$, Greenland cryolite, $CaF_2$ and $Al_2O_3$ so that NaF:$AlF_3$=1.1, $Al_2O_3$=5 weight $CaF_2$=5 weight percent. In these experiments, dried air was circulated over the salt bath at a low flow rate of 100 cm3/min, as well as periodically bubbled into the molten salt to maintain oxidizing conditions. Samples of the melt were withdrawn periodically for chemical bath analysis.

Figure 4:
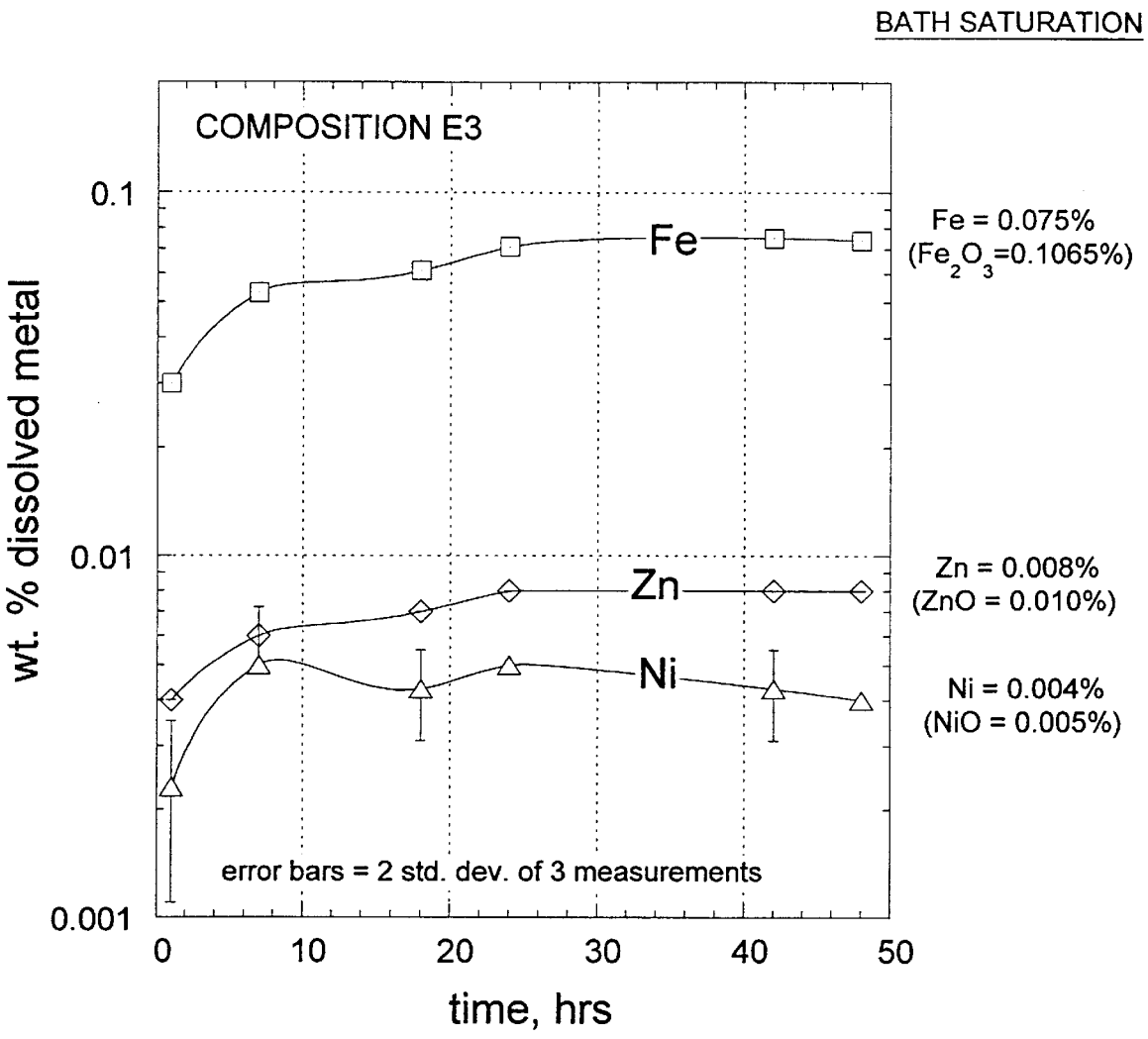
FIG. 4 is a graph showing examples of the weight percentages of dissolved metals in a salt bath typically used in an aluminum production cell after anode compositions containing nickel oxide, iron oxide and varying amounts of zinc oxide have been exposed to the salt bath.

FIG. 4 shows Fe, Zn and Ni impurity levels periodically measured for composition E3. After 50 hours, the Fe solubility was 0.075 weight percent, which translates to an $Fe_2O_3$ solubility of 0.1065 weight percent. The solubility of Zn was 0.008 weight percent, which corresponds to a ZnO solubility of 0.010 weight percent. The solubility of Ni was 0.004 weight percent, which translates to a NiO solubility of 0.005 weight percent.

When the foregoing solubility test method is used, the weight percent of total dissolved oxides is preferably below 0.1 weight percent, more preferably below 0.08 weight percent. The amount of total dissolved oxides, i.e., $Fe_2O_3$, NiO and ZnO, as measured by the foregoing procedure, is defined herein as the "Hall cell bath solubility." The Hall cell bath solubility of the present compositions, is preferably below the solubility of stoichiometric nickel ferrite.

Table 3 lists the nominal composition of each ceramic phase sample tested, the average weight percent of dissolved metal (Fe, Ni and Zn) in the electrolyte bath, and the average weight percent of dissolved oxide ($Fe_2O_3$, NiO and ZnO) in the electrolyte bath. The dissolved metal and oxide levels were determined after the bath composition had reached saturation with the components of the oxide test samples. The results are also expressed as bath oxide saturation values. The total dissolved oxide content of the bath is the sum of the oxide saturation values, with a low total dissolved oxide content being desirable.

TABLE 3

Ceramic Phase Solubility in Standard Salt Bath at 960° C.

| Nominal Composition | Sample ID | Average weight percent dissolved metal | | | Average weight percent dissolved oxide | | | |
|---|---|---|---|---|---|---|---|---|
| | | Fe | Ni | Zn | $Fe_2O_3$ | NiO | ZnO | Total |
| NiO | X | 0.014* | 0.032 | <0.004* | 0.020* | 0.041 | 0.006* | 0.068 |
| $Fe_2O_3$ | Z | 0.097 | na | na | 0.139 | 0.003* | 0.006* | 0.148 |
| $NiFe_2O_4$ | 5412 (D) | 0.052 | 0.009 | 0.004 | 0.074 | 0.011 | 0.005* | 0.090 |
| $NiFe_2O_4$ + NiO | 5324 | 0.033 | 0.018 | <0.004* | 0.047 | 0.023 | 0.006* | 0.076 |
| ZnO | Y | na | na | 0.082 | 0.020* | 0.003* | 0.102 | 0.125 |
| ZnO | Y | na | na | 0.085 | 0.020* | 0.003* | 0.106 | 0.129 |
| $ZnFe_2O_4$ | F | 0.075 | na | 0.039 | 0.107 | 0.003* | 0.049 | 0.159 |
| $ZnFe_2O_4$ | F | 0.087 | <0.001* | 0.052 | 0.124 | <0.001 | 0.065 | 0.190 |
| $Ni_{0.67}Zn_{0.33}O$ | BC2 | na | 0.033 | 0.053 | 0.020* | 0.042 | 0.066 | 0.128 |
| $Ni_{0.67}Zn_{0.33}O$ | BC2 | na | 0.011 | 0.056 | 0.020* | 0.014 | 0.070 | 0.104 |
| $Ni_{0.5}Zn_{0.5}Fe_2O_4$ | E | 0.086 | 0.002 | 0.031 | 0.123 | 0.003 | 0.038 | 0.164 |
| $Ni_{0.75}Zn_{0.25}Fe_{1.90}O_4$ | E1 | 0.086 | 0.005 | 0.022 | 0.123 | 0.006 | 0.027 | 0.156 |
| $Ni_{0.75}Zn_{0.25}Fe_2O_4$ | E2 | 0.082 | 0.004 | 0.018 | 0.117 | 0.005 | 0.022 | 0.144 |
| $Ni_{0.90}Zn_{0.10}Fe_2O_4$ | E3 | 0.075 | 0.004 | 0.008 | 0.107 | 0.005 | 0.010 | 0.122 |
| $Ni_{0.95}Zn_{0.05}Fe_2O_4$ | E4 | 0.070 | 0.004 | 0.005 | 0.100 | 0.006 | 0.006 | 0.112 |
| $NiZnFeO_4$ | L | 0.006 | 0.004 | 0.102 | 0.009 | 0.005 | 0.127 | 0.141 |
| $NiZn_{0.5}Fe_{1.5}O_4$ | H | 0.018 | 0.011 | 0.052 | 0.026 | 0.014 | 0.065 | 0.105 |
| $Ni_{1.5}Zn_{0.5}FeO_4$ | J | 0.011 | 0.007 | 0.029 | 0.016 | 0.009 | 0.036 | 0.061 |
| $Ni_{1.05}Zn_{0.05}Fe_{1.9}O_4$ | ZD6 | 0.049 | 0.004 | 0.008 | 0.070 | 0.004 | 0.008 | 0.085 |
| $NiFe_2O_4$ + 5% ZnO | — | 0.054 | 0.005 | 0.014 | 0.077** | 0.006 | 0.017** | 0.100 |
| $Ni_{0.95}Zn_{0.12}Fe_{1.9}O_4$ | — | 0.034 | 0.008 | 0.014 | 0.049 | 0.010 | 0.018 | 0.077 |
| $Ni_{0.94}Zn_{0.12}Fe_{1.88}O_4$ | ZD3 | 0.062** | 0.005 | 0.010 | 0.089** | 0.006 | 0.012 | >0.107 |
| $Ni_{0.94}Zn_{0.12}Fe_{1.88}O_4$ | ZD3 | 0.044** | 0.005 | 0.019 | 0.063** | 0.006 | 0.024 | >0.093 |
| $Ni_{1.17}Zn_{0.08}Fe_{1.50}O_4$ | DI | 0.019 | 0.012 | 0.009 | 0.027 | 0.015 | 0.011 | 0.053 |
| $Ni_{0.75}Zn_{0.50}Fe_{1.50}O_4$ | ZD1 | 0.052 | 0.065 | 0.042 | 0.074 | 0.008 | 0.052 | 0.134 |
| $Ni_{1.10}Zn_{0.17}Fe_{1.50}O_4$ | DJ | 0.024 | 0.004 | 0.014 | 0.034 | 0.005 | 0.017 | 0.056 |
| $Ni_{0.96}Zn_{0.17}Fe_{1.50}O_4$ | DH | 0.044 | 0.007 | 0.022 | 0.063 | 0.009 | 0.027 | 0.099 |
| $Ni_{1.10}Zn_{0.10}Fe_{1.80}O_4$ | ZD5 | 0.039 | 0.006 | 0.012 | 0.056 | 0.0076 | 0.015 | 0.079 |

NOTES: na = not analyzed, * means at salt background level, ** means did not reach saturation after 96 hrs.

Figure 5:
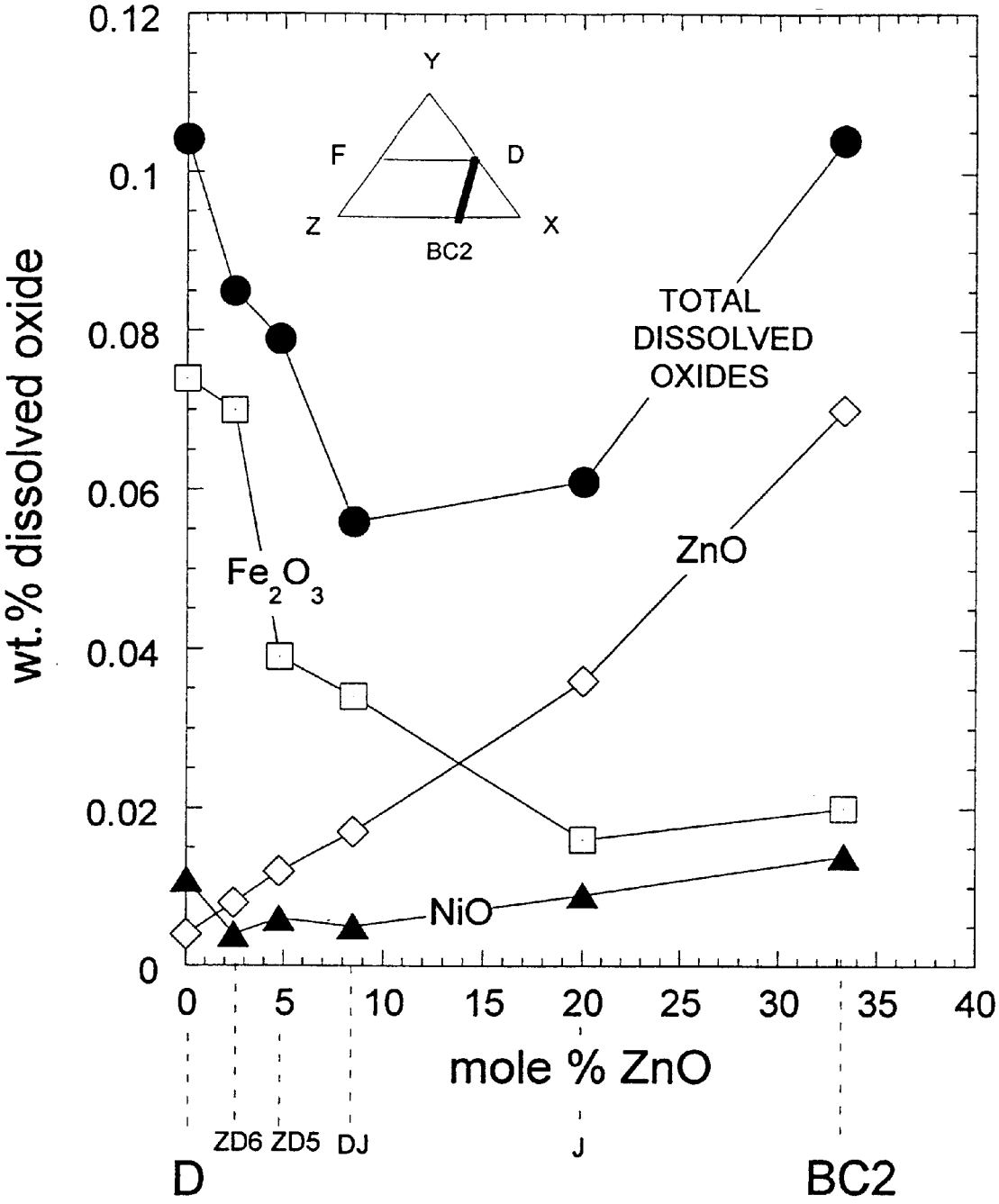
FIGS. 5 and 6 are graphs showing examples of the weight percentages of dissolved oxides in a salt bath typically used in an aluminum electrolytic reduction cell after anode compositions containing nickel oxide, iron oxide and varying amounts of zinc oxide have been exposed to the salt bath.
Figure 6:
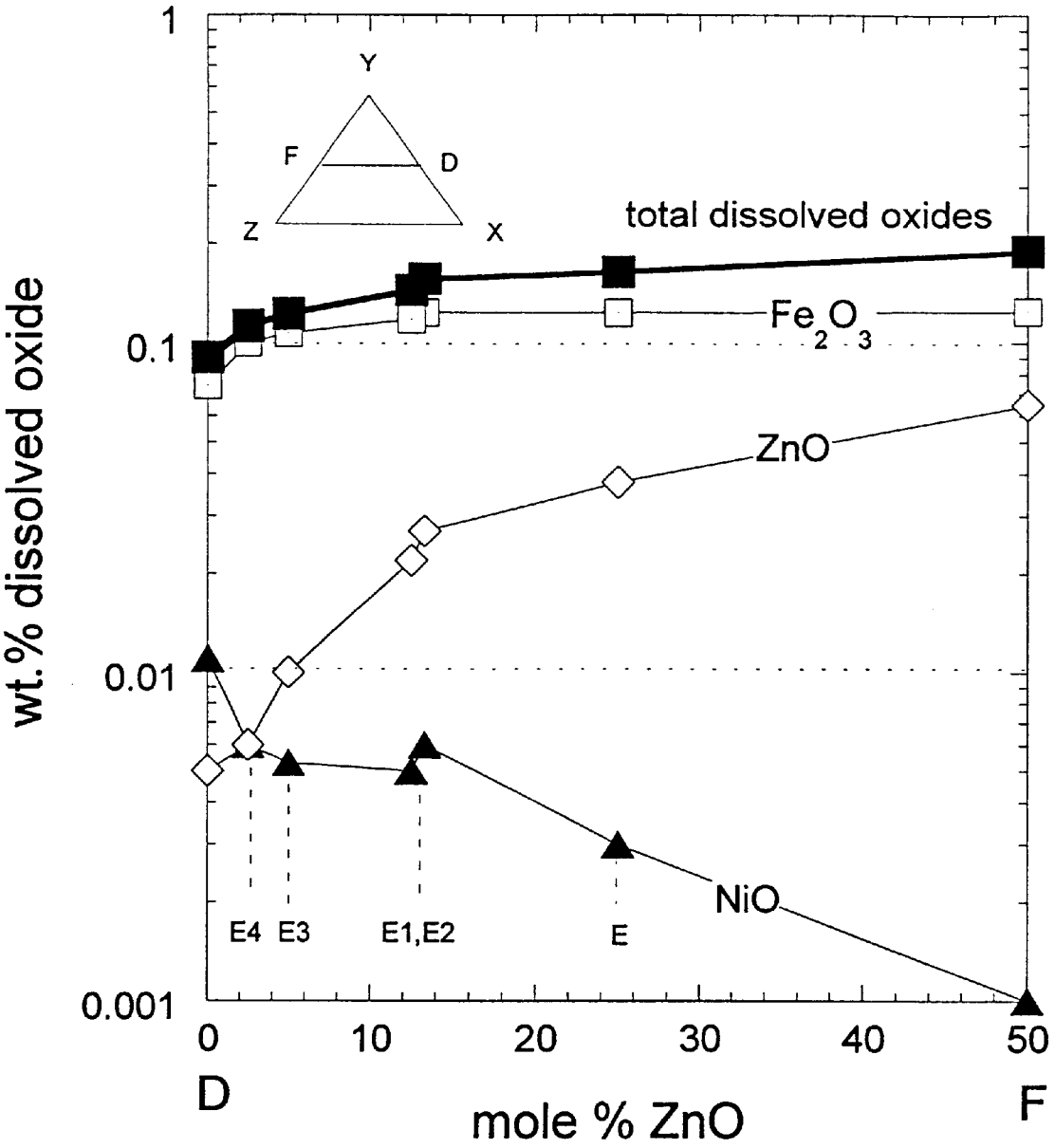

FIGS. 5 and 6 graphically illustrate the amount of dissolved oxides for samples comprising varying amounts of NiO, $Fe_2O_3$ and ZnO. The compositions shown in FIG. 5 exhibit very low oxide dissolution, particularly for compositions containing from 1 to 30 mole percent ZnO. Zinc oxide concentrations of from 5 to 25 mole percent exhibit extremely low oxide solubility. The compositions illustrated in FIG. 5 fall along the line from point BC2 to point D in FIG. 3. The compositions shown in FIG. 6 exhibit higher oxide solubility compared with the compositions of FIG. 5. The compositions of FIG. 6 fall along the spinel line from point F to point D in FIG. 3. Unlike compositions falling along the line BC2-D, those along the line D-F exhibit no minimum in oxide solubility, as illustrated in FIG. 6. The total dissolved oxide content of the bath increases as the composition of the oxide moves from $NiFe_2O_4$ to $ZnFe_2O_4$. The improved oxide compositions of the present invention which exhibit substantially lower electrolyte solubility are shown in the compositional regions of FIG. 2.

Figure 7:
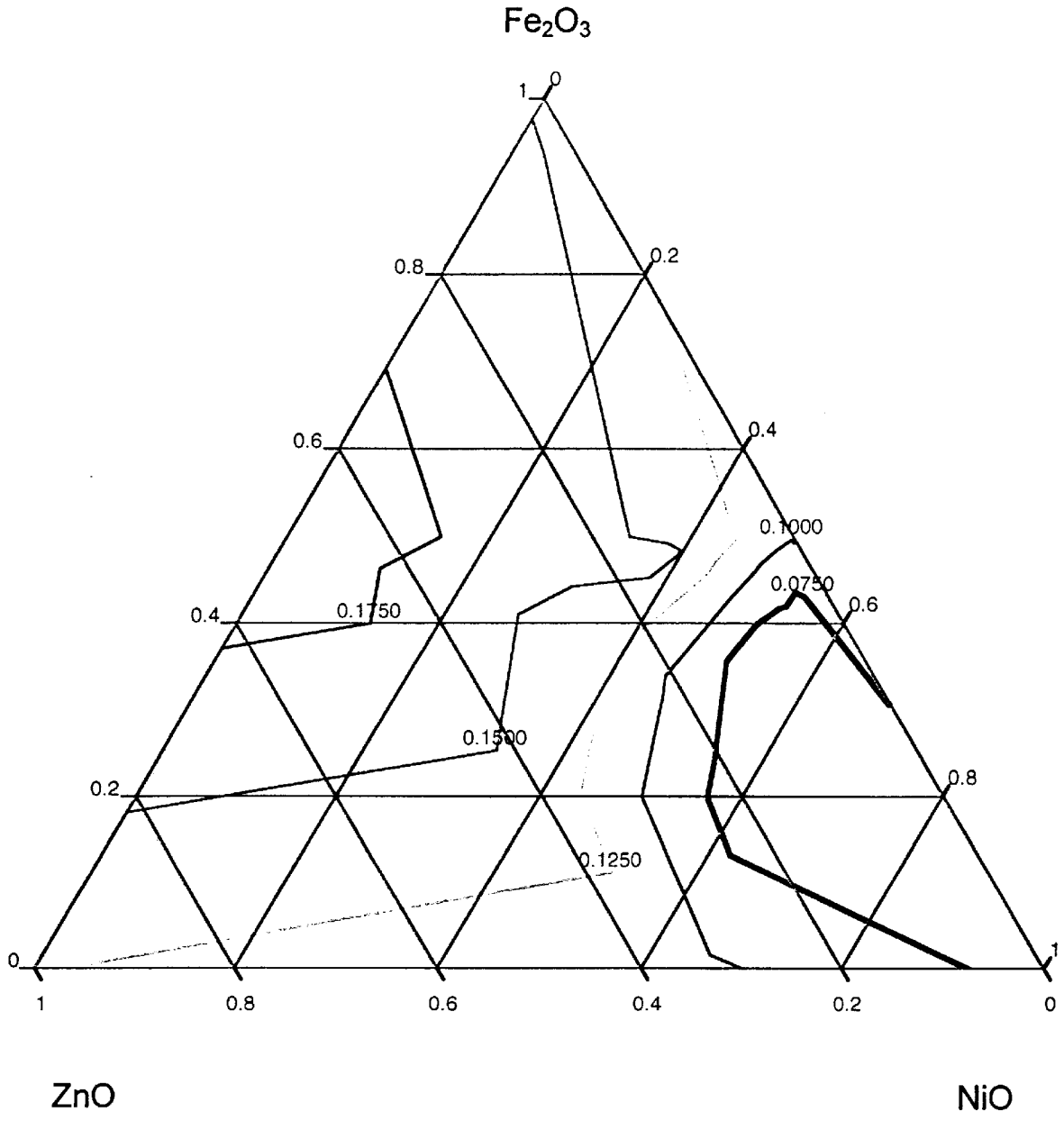
FIG. 7 is a contour plot of NiO, $Fe_2O_3$ and ZnO dissolved oxides in a standard aluminum reduction salt bath for varying compositions of Ni—Fe—Zn—O anode materials.

Commercially available software (JMP) was used to fit contours of the solubility results listed in Table 3. FIG. 7 is a contour plot of total dissolved oxides (NiO, $Fe_2O_3$ and ZnO) for ceramic compositions comprising varying amounts of NiO; $Fe_2O_3$ and ZnO. A region in which the level of total dissolved oxides is below 0.10 weight percent is illustrated in FIG. 7, as well as a region in which the level of total dissolved oxides is less than 0.075 weight percent.

Figure 8:
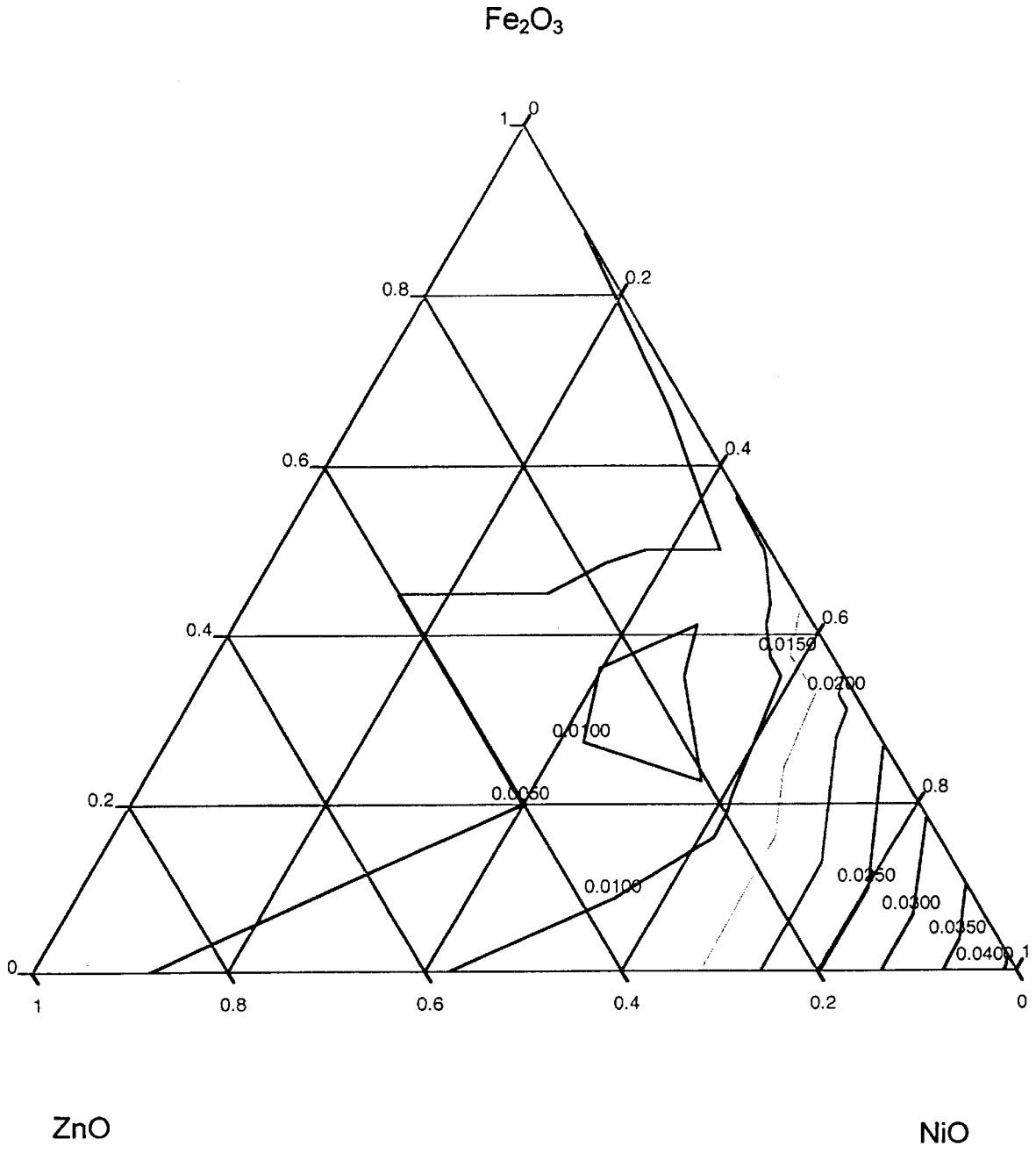
FIG. 8 is a contour plot of NiO solubility in a standard aluminum reduction salt bath for varying compositions of Ni—Fe—Zn—O anode materials.

FIG. 8 is a contour plot of dissolved NiO for ceramic phase compositions comprising varying amounts of NiO, $Fe_2O_3$ and ZnO. As shown in the lower right corner of the diagram of FIG. 8, ceramic compositions which are NiO-rich yield the highest levels of dissolved NiO. For example, regions in which the levels of dissolved NiO are greater than 0.025, 0.030, 0.035 and 0.040 weight percent are illustrated in FIG. 8. Such high levels of dissolved NiO are particularly disadvantageous during the production of commercial purity aluminum because the commercial purity standards which dictate the maximum allowable amounts of nickel impurities are very stringent, e.g., 0.03 or 0.34 weight percent maximum Ni. The preferred ceramic phase compositions of the present invention not only exhibit substantially reduced total oxide solubilities, but also exhibit substantially reduced NiO solubilities.

In another embodiment of the present invention, the ceramic phase of the cermet material comprises iron, nickel and cobalt oxides. In this embodiment, the ceramic phase preferably comprises nickel, iron and cobalt oxide, and is of the formula $Ni_xFe_{2y}Co_zO_{(3y+x+z)\pm\delta}$. In the foregoing formula, the oxygen stoichiometry is not necessarily equal to 3y+x+z, but may change slightly up or down depending upon firing conditions by a factor of δ. The value of δ may range from 0 to about 0.3, preferably from 0 to about 0.2.

In this embodiment, the mole fraction of NiO typically ranges from about 0.15 to about 0.99, the mole fraction of $Fe_2O_3$ typically ranges from about 0.0001 to about 0.85, and the mole fraction of CoO typically ranges from about 0.0001 to about 0.45. In a preferred composition, the mole fraction of NiO ranges from about 0.15 to about 0.6, the mole fraction of $Fe_2O_3$ ranges from about 0.4 to about 0.6, and the mole fraction of CoO ranges from about 0.001 to about 0.25. In more preferred compositions, the mole fraction of NiO ranges from about 0.25 to about 0.55, the mole fraction of $Fe_2O_3$ ranges from about 0.45 to about 0.55, and the mole fraction of CoO ranges from about 0.001 to about 0.2. Table 4 lists the typical, preferred and more preferred mole faction ranges of NiO, $Fe_2O_3$ and CoO. The listed mole fractions may be multiplied by 100 to indicate mole percentages. Within these ranges, the solubility of the constituent oxides in an electrolyte bath is reduced significantly. Lower oxide solubility is believed to improve the purity of the aluminum produced in the bath.

TABLE 4

Mole Fractions of NiO, $Fe_2O_3$ and CoO

| | NiO | $Fe_2O_3$ | CoO |
|---|---|---|---|
| Typical | 0.15–0.99 | 0.0001–0.85 | 0.0001–0.45 |
| Preferred | 0.15–0.6 | 0.4–0.6 | 0.001–0.25 |
| More Preferred | 0.25–0.55 | 0.45–0.55 | 0.001–0.2 |

Figure 9:
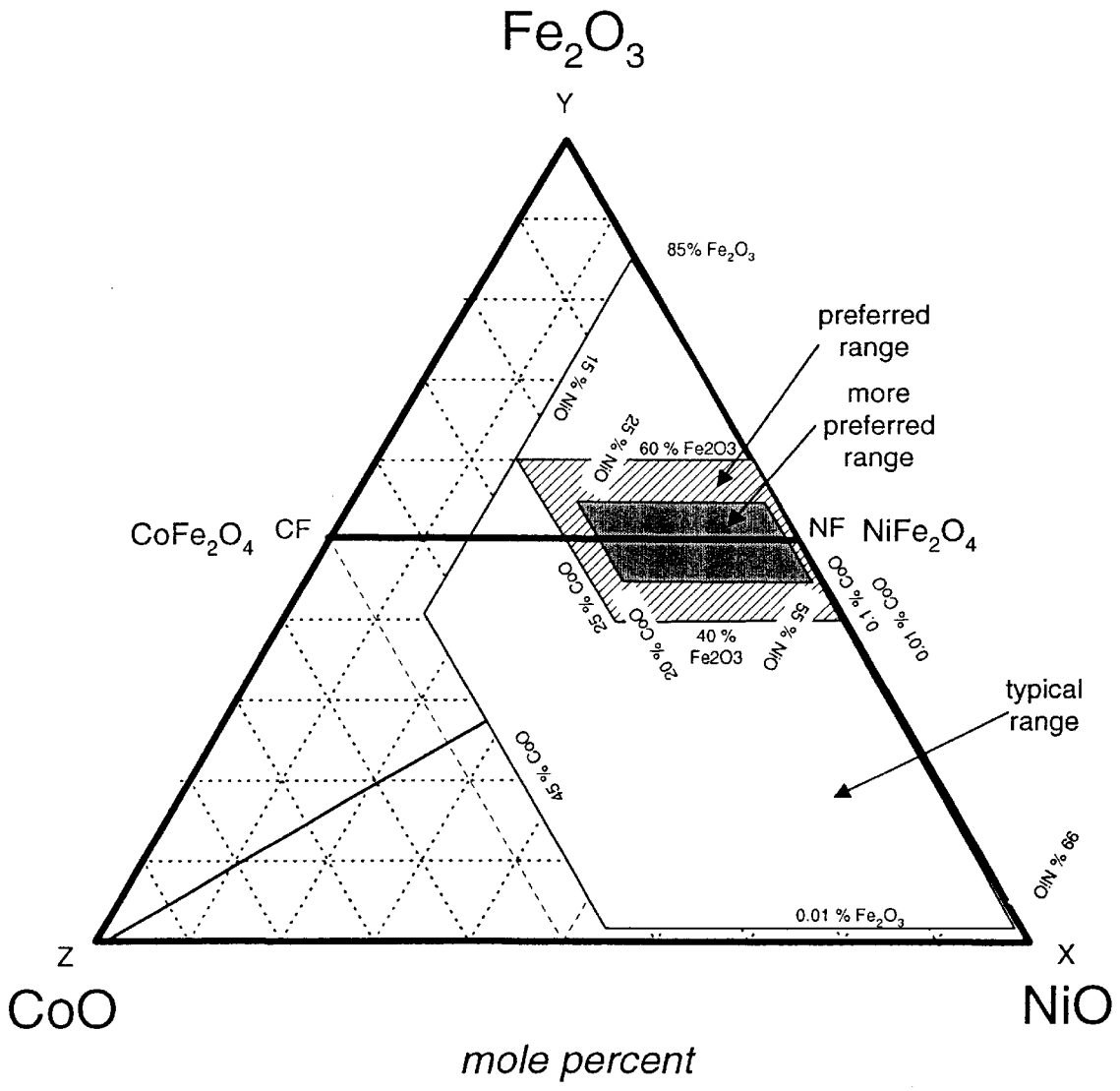
FIG. 9 is a ternary phase diagram illustrating compositional ranges of nickel, iron and cobalt oxides utilized in inert anode compositions in accordance with another embodiment of the present invention.

FIG. 9 is a ternary phase diagram illustrating typical, preferred and more preferred ranges of NiO, $Fe_2O_3$ and CoO starting materials used to make inert anode compositions in accordance with this embodiment of the present invention. Although the mole percentages illustrated in FIG. 9 are based on NiO, $Fe_2O_3$ and CoO starting materials, other iron, nickel and cobalt oxides, or compounds which form oxides upon calcination, may be used as starting materials.

Table 5 lists some Ni—Fe—Co—O materials that may be suitable as the ceramic phase of the present cermet inert anodes, as well as Co—Fe—O and Ni—Fe—O comparison materials. In addition to the phases listed in Table 5, minor or trace amounts of other phases may be present.

TABLE 5

Ni—Fe—Co—O Compositions

| Sample I. D. | Nominal Composition | Measured Elemental Weight Percent Fe, Ni, Zn | Structural Types (identified by XRD) |
|---|---|---|---|
| CF | $CoFe_2O_4$ | 44, 0.17, 24 | $CoFe_2O_4$ |
| NCF1 | $Ni_{0.5}Co_{0.5}Fe_2O_4$ | 44, 12, 11 | $NiFe_2O_4$ |
| NCF2 | $Ni_{0.7}Co_{0.3}Fe_2O_4$ | 45, 16, 7.6 | $NiFe_2O_4$ |
| NCF3 | $Ni_{0.7}Co_{0.3}Fe_{1.95}O_4$ | 42, 18, 6.9 | $NiFe_2O_4$ |
| NCF4 | $Ni_{0.85}Co_{0.15}Fe_{1.95}O_4$ | 44, 20, 3.4 | $NiFe_2O_4$ |
| NCF5 | $Ni_{0.80}Co_{0.3}Fe_{1.9}O_4$ | 45, 20, 7.0 | $NiFe_2O_4$, NiO |
| NF | $NiFe_2O_4$ | 48, 23, 0 | N/A |

Figure 10:
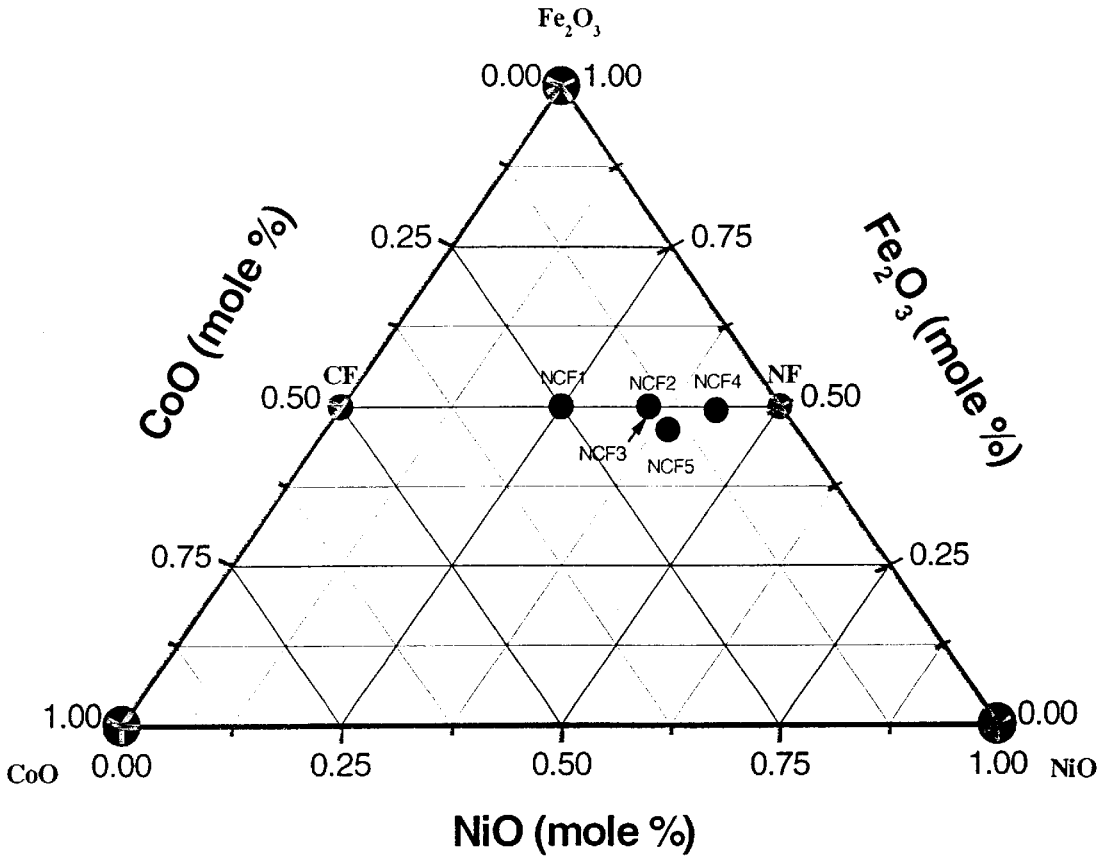
FIG. 10 is a ternary phase diagram illustrating the amounts of nickel, iron and cobalt oxides utilized in specific inert anode compositions in accordance with embodiments of the present invention.

FIG. 10 is a ternary phase diagram illustrating the amounts of NiO, $Fe_2O_3$ and CoO starting materials used to make the compositions listed in Table 2, which may be used as the ceramic phase(s) of cermet inert anodes. Such inert anodes may in turn be used to produce commercial purity aluminum in accordance with the present invention.

The solubilities of the Ni—Fe—Co—O ceramic phase compositions were tested by holding approximately 3 g of sintered oxide pellets in 160 g of a standard cryolitic molten salt bath at 960° C. for 96 hours. The standard salt bath was contained in a platinum crucible and prepared by batching NaF, $AlF_3$, Greenland cryolite, $CaF_2$ and $Al_2O_3$ so that NaF:$AlF_3$=1.1, $Al_2O_3$=5 weight percent, and. $CaF_2$=5 weight percent. Dried air was circulated over the salt bath at a low flow rate of 100 $cm^3$/min, as well as periodically bubbled into the molten salt to maintain oxidizing conditions. Samples of the melt were withdrawn periodically for chemical analysis. When the foregoing solubility test method is used, the weight percentage of total dissolved oxides is preferably below 0.1 weight percent, more preferably below 0.08 weight percent. The Hall cell bath solubility, i.e., amount of total dissolved oxides $Fe_2O_3$, NiO and $Co_3O_4$, as measured by the foregoing procedure, is preferably below the solubility of stoichiometric nickel ferrite.

Table 6 lists the Hall cell bath solubilities for Ni—Fe—Co—O ceramic phase materials of the present invention in comparison with solubilites for nickel ferrite and cobalt ferrite compositions. The solubility values listed in Table 6 were measured after bath saturation. The total dissolved oxide content of each bath is the sum of the oxide saturation values, with a low total dissolved oxide content being desirable.

TABLE 6

Oxide Solubilities

| Sample I. D. | Nominal Composition | Bath Saturation (weight percent) NiO | $Fe_2O_3$ | $Co_3O_4$ | Total |
|---|---|---|---|---|---|
| CF | $CoFe_2O_4$ | 0.003 | 0.110 | 0.055 | 0.168 |
| NCF1 | $Ni_{0.5}Co_{0.5}Fe_2O_4$ | 0.005 | 0.089 | 0.026 | 0.120 |
| NCF3 | $Ni_{0.7}Co_{0.3}Fe_{1.95}O_4$ | 0.006 | 0.040 | 0.007 | 0.053 |
| NCF4 | $Ni_{0.85}Co_{0.15}Fe_{1.95}O_4$ | 0.011 | 0.056 | 0.006 | 0.073 |
| NCF5 | $Ni_{0.8}Co_{0.3}Fe_{1.9}O_4$ | 0.006 | 0.086 | 0.017 | 0.109 |
| NF | $NiFe_2O_4$ | 0.011 | 0.074 | <0.001 | 0.085 |
| NF | $NiFe_2O_4$ | 0.010 | 0.090 | <0.001 | 0.10 |

Figure 11:
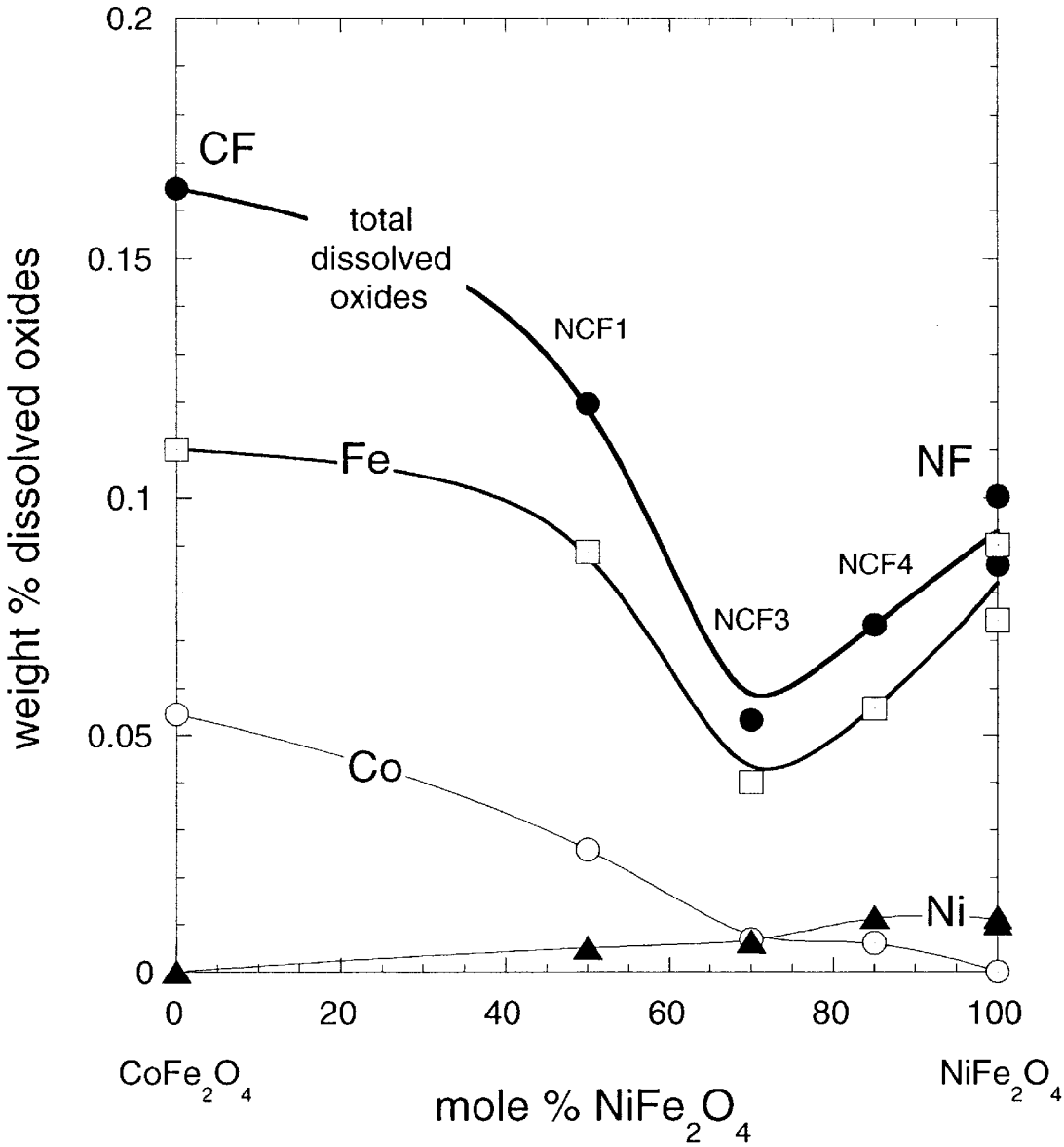
FIG. 11 is a graph showing examples of the weight percentages of dissolved iron, cobalt and nickel oxides in a salt bath typically used in an aluminum production cell after anode compositions containing nickel oxide, iron oxide and varying amounts of cobalt oxide have been exposed to the salt bath.

FIG. 11 shows the Fe, Co and Ni oxide solubility levels listed in Table 6. The ceramic phase compositions of the present invention listed in Table 6 and shown in FIG. 11 exhibit very low oxide dissolution values, particularly for compositions NCF3 and NCF4 which possess Hall cell bath solubilities of less than 0.08 weight percent total dissolved oxides.

In addition to the above-noted ceramic phase materials, the cermet inert anodes of the present invention include at least one metal phase. The metal phase may be continuous or discontinuous, and preferably comprises a base metal and at least one noble metal. When the metal phase is continuous, it forms an interconnected network or skeleton which may substantially increase electrical conductivity of the cermet anode. When the metal phase is discontinuous, discrete particles of the metal are at least partially surrounded by the ceramic phase(s), which may increase corrosion resistance of the cermet anode.

Copper and silver are preferred base metals of the metal phase. However, other metals may optionally be used to replace all or part of the copper or silver. Furthermore, additional metals such as Co, Ni, Fe, Al, Sn, Nb, Ta, Cr, Mo, W and the like may be alloyed with the base metal of the metal phase. Such base metals may be provided from individual or alloyed powders of the metals, or as oxides or other compounds of such metals, e.g., CuO, $Cu_2O$, etc.

The noble metal of the metal phase preferably comprises at least one metal selected from Ag, Pd, Pt, Au, Rh, Ru, Ir and Os. More preferably, the noble metal comprises Ag, Pd, Pt, Ag and/or Rh. Most preferably, the noble metal comprises Ag, Pd or a combination thereof. The noble metal may be provided from individual or alloyed powders of the metals, or as oxides or other compounds of such metals, e.g., silver oxide, palladium oxide, etc.

In a preferred embodiment, the metal phase typically comprises from about 50 to about 99.99 weight percent of the base metal, and from about 0.01 to about 50 weight percent of the noble metal(s). Preferably, the metal phase comprises from about 70 to about 99.95 weight percent of the base metal, and from about 0.05 to about 30 weight percent of the noble metal(s). More preferably, the metal phase comprises from about 90 to about 99.9 weight percent of the base metal, and from about 0.1 to about 10 weight percent of the noble metal(s).

The types and amounts of base and noble metals contained in the metal phase of the inert anode are selected in order to substantially prevent unwanted corrosion, dissolution or reaction of the inert anodes, and to withstand the high temperatures which the inert anodes are subjected to during the electrolytic metal reduction process. For example, in the electrolytic production of aluminum, the production cell typically operates at sustained smelting temperatures above 800° C., usually at temperatures of 900–980° C. Accordingly, inert anodes used in such cells should preferably have metal phase melting points above 800° C., more preferably above 900° C., and optimally above about 1,000° C.

In one embodiment of the invention, the metal phase of the anode comprises copper as the base metal and a relatively small amount of silver as the noble metal. In this embodiment, the silver content is preferably less than about 10 or 15 weight percent. For example, the Ag may comprise from about 0.2 to about 9 weight percent, or may comprise from about 0.5 to about 8 weight percent, remainder copper. By combining such relatively small amounts of Ag with such relatively large amounts of Cu, the melting point of the Cu—Ag alloy phase is significantly increased. For example, an alloy comprising 95 weight percent Cu and 5 weight percent Ag has a melting point of approximately 1,000° C., while an alloy comprising 90 weight percent Cu and 10 weight percent Ag forms a eutectic having a melting point of approximately 780° C. This difference in melting points is particularly significant where the alloys are to be used as part of inert anodes in electrolytic aluminum reduction cells, which typically operate at smelting temperatures of greater than 800° C.

In another embodiment of the invention, the metal phase comprises copper as the base metal and a relatively small amount of palladium as the noble metal. In this embodiment, the Pd content is preferably less than about 20 weight percent, more preferably from about 0.1 to about 10 weight percent.

In a further embodiment of the invention, the metal phase comprises silver as the base metal and a relatively small amount of palladium as the noble metal. In this embodiment, the Pd content is preferably less than about 50 weight percent, more preferably from about 0.05 to about 30 weight percent, and optimally from about 0 to about 20 weight percent. Alternatively, silver may be used alone as the metal phase of the anode.

In another embodiment of the invention, the metal phase of the anode comprises Cu, Ag and Pd. In this embodiment, the amounts of Cu, Ag and Pd are preferably selected in order to provide an alloy having a melting point above 800° C., more preferably above 900° C., and optimally above about 1,000° C. The silver content is preferably from about 0.5 to about 30 weight percent of the metal phase, while the Pd content is preferably from about 0.01 to about 10 weight percent. More preferably, the Ag content is from about 1 to about 20 weight percent of the metal phase, and the Pd content is from about 0.1 to about 10 weight percent. The weight ratio of Ag to Pd is preferably from about 2:1 to about 100:1, more preferably from about 5:1 to about 20:1.

In accordance with one embodiment of the present invention, the types and amounts of base and noble metals contained in the metal phase are selected such that the resultant material forms at least one alloy phase having an increased melting point above the eutectic melting point of the particular alloy system. For example, as discussed above in connection with the binary Cu—Ag alloy system, the amount of the Ag addition may be controlled in order to substantially increase the melting point above the eutectic melting point of the Cu—Ag alloy. Other noble metals, such as Pd and the like, may be added to the binary Cu—Ag alloy system in controlled amounts in order to produce alloys having melting points above the eutectic melting points of the alloy systems. Thus, binary, ternary, quaternary, etc. alloys may be produced in accordance with the present invention having sufficiently high melting points for use as part of cermet inert anodes in electrolytic metal production cells.

The present cermet inert anodes may be formed by techniques such as powder sintering, sol-gel processes, slip casting and spray forming. Preferably, the inert anodes are formed by powder techniques in which powders comprising the oxides and metals are pressed and sintered. The inert anode may comprise a monolithic component of such materials. Alternatively, the inert anode may comprise a substrate having at least one coating or outer layer of the present cermet material, or may comprise a core of the present cermet material coated with a material of different composition, such as a ceramic which does not include a metal phase or which includes a reduced amount of a metal phase.

Prior to combining the ceramic and metal powders, the ceramic powders, such as commercially available NiO, $Fe_2O_3$ and ZnO or CoO powders, may be blended in a mixer. Optionally, the blended ceramic powders may be ground to a smaller size before being transferred to a furnace where they are calcined, e.g., for 12 hours at 1,250° C. The calcination produces a mixture made from oxide phases, for example, as illustrated in FIGS. 2, 3, 9 and 10. If desired, the mixture may include other oxide powders such as $Cr_2O_3$ or oxide-forming metals such as Al.

The oxide mixture may be sent to a ball mill where it is ground to an average particle size of approximately 10 microns. The fine oxide particles are blended with a polymeric binder and water to make a slurry in a spray dryer. The slurry contains, e.g., about 60 wt. % solids and about 40 wt. % water. Spray drying the slurry produces dry agglomerates of the oxides that may be transferred to a V-blender and mixed with metal powders. Alternatively, the oxide and metal constituents may be spray dried together. The metal powders may comprise substantially pure metals and alloys thereof, or may comprise oxides of the base metal and/or noble metal.

In a preferred embodiment, about 0.1–10 parts by weight of an organic polymeric binder, plasticizers and dispersants are added to 100 parts by weight of the ceramic and metal particles. Some suitable binders include polyvinyl alcohol, acrylic polymers, polyglycols, polyvinyl acetate, olyisobutylene, polycarbonates, polystyrene, polyacrylates, and mixtures and copolymers thereof. Preferably, about 0.3–6 parts by weight of the binder are added to 100 parts by weight of the ceramic and metal mixture.

The blended mixture of ceramic and metal powders may be sent to a press where it is isostatically pressed, for example at 10,000 to 40,000 psi, into anode shapes. A pressure of about 20,000 psi is particularly suitable for many applications. The pressed shapes may be sintered in a controlled atmosphere furnace supplied with an argon-oxygen gas mixture, a nitrogen-oxygen gas mixture, or other suitable mixtures. Sintering temperatures of 1,000–1,400° C. may be suitable. The furnace is typically operated at 1,350–1,385° C. for 2–4 hours. The sintering process burns out any polymeric binder from the anode shapes.

The gas supplied during sintering preferably contains about 5–3,000 ppm oxygen, more preferably about 5–700 ppm and most preferably about 10–350 ppm. Lesser concentrations of oxygen result in a product having a larger metal phase than desired, and excessive oxygen results in a product having too much of the phase containing metal oxides (ceramic phase). The remainder of the gaseous atmosphere preferably comprises a gas such as argon that is inert to the metal at the reaction temperature.

Sintering anode compositions in an atmosphere of controlled oxygen content typically lowers the porosity to acceptable levels and avoids bleed out of the metal phase. The atmosphere may be predominantly argon, with controlled oxygen contents in the range of 17 to 350 ppm. The anodes may be sintered in a tube furnace at 1,350° C. for 2 hours. Anode compositions sintered under these conditions typically have less than 0.5% porosity when the compositions are sintered in argon containing 70–150 ppm oxygen.

The sintered anode may be connected to a suitable electrically conductive support member within an electrolytic metal production cell by means such as welding, diffusion welding, brazing, mechanical fastening, cementing and the like. For example, the inert anode may include a cermet as described above successively connected in series to a transition region of higher metal content, and to a metal or metal alloy end such as nickel or Inconel. A nickel or nickel-chromium alloy rod may be welded to the metal end. The transition region, for example, may include four layers of graded composition, ranging from 25 wt. % Ni adjacent the cermet end and then 50, 75 and 100 wt. % Ni, balance the mixture of oxide and metal powders described above.

We prepared several cermet inert anode compositions in accordance with the procedures described above having diameters of either about ⅝ inch or about 2 inches and length of about 5 inches. These compositions were evaluated in a Hall-Heroult test cell similar to that schematically illustrated in FIG. 1. The cell was operated for 100 hours at 960° C., with an aluminum fluoride to sodium fluoride bath ratio of about 1:1 and alumina concentration maintained at about 7–7.5 wt. %. The anode compositions and impurity concentrations in aluminum produced by the cell are shown in Table 7. The impurity values shown in Table 7 represent the average of four test samples of the produced metal taken at four different locations after the 100 hour test period. Interim samples of the produced aluminum were consistently below the final impurity levels listed.

TABLE 7

| Sample No. | Composition | Porosity | Fe | Cu | Ni |
|---|---|---|---|---|---|
| 1 | 3Ag-14Cu-42.9NiO-40.1$Fe_2O_3$ | | 0.191 | 0.024 | 0.044 |
| 2 | 3Ag-14Cu-42.9NiO-40.1$Fe_2O_3$ | | 0.26 | 0.012 | 0.022 |
| 3 | 3Ag-14Cu-26.45NiO-56.55$Fe_2O_3$ | | 0.375 | 0.13 | 0.1 |
| 4 | 3Ag-14Cu-42.9NiO-40.1$Fe_2O_3$ | | 0.49 | 0.05 | 0.085 |
| 5 | 3Ag-14Cu-42.9NiO-40.1$Fe_2O_3$ | | 0.36 | 0.034 | 0.027 |
| 6 | 5Ag-10Cu-43.95NiO-41.05$Fe_2O_3$ | | 0.4 | 0.06 | 0.19 |
| 7 | 3Ag-14Cu-42.9NiO-40.1$Fe_2O_3$ | | 0.38 | 0.095 | 0.12 |
| 8 | 2Ag-15Cu-42.9NiO-40.1$Fe_2O_3$ | | 0.5 | 0.13 | 0.33 |
| 9 | 2Ag-15Cu-42.9NiO-40.1$Fe_2O_3$ | | 0.1 | 0.16 | 0.26 |
| 10 | 3Ag-11Cu-44.46NiO-41.54$Fe_2O_3$ | | 0.14 | 0.017 | 0.13 |
| 11 | 1Ag-14Cu-27.75NiO-57.25$Fe_2O_3$ | | 0.24 | 0.1 | 0.143 |
| 12 | 1Ag-14Cu-27.96NiO-57.04$Fe_2O_3$ | 0.127 | 0.07 | 0.011 | 0.0212 |
| 13 | 1Ag-14Cu-27.96NiO-57.04$Fe_2O_3$ | 0.168 | 0.22 | 0.04 | 0.09 |
| 14 | 1Ag-14Cu-27.96NiO-57.04$Fe_2O_3$ | 0.180 | 0.1 | 0.03 | 0.05 |
| 15 | 1Ag-14Cu-27.96NiO-57.04$Fe_2O_3$ | 0.175 | 0.12 | 0.04 | 0.06 |
| 16 | 1Ag-14Cu-27.96NiO-57.04$Fe_2O_3$ | 0.203 | 0.08 | 0.02 | 0.1 |
| 17 | 1Ag-14Cu-27.96NiO-57.04$Fe_2O_3$ | 0.230 | 0.12 | 0.01 | 0.04 |
| 18 | 1Ag-14Cu-27.96NiO-57.04$Fe_2O_3$ | 0.184 | 0.17 | 0.18 | 0.47 |
| 19 | 1Ag-14Cu-27.96NiO-57.04$Fe_2O_3$ | 0.193 | 0.29 | 0.044 | 0.44 |
| 20 | 1Ag-14Cu-5ZnO-28.08NiO-56.92$Fe_2O_3$ | 0.201 | 0.16 | 0.02 | 0.02 |
| 21 | 1Ag-14Cu-27.96NiO-57.04$Fe_2O_3$ | 0.144 | 0.44 | 0.092 | 0.15 |
| 22 | 1Ag-14Cu-5ZnO-28.08NiO-56.92$Fe_2O_3$ | 0.191 | 0.48 | 0.046 | 0.17 |
| 23 | 1Ag-14Cu-5ZnO-28.08NiO-56.92$Fe_2O_3$ | 0.214 | 0.185 | 0.04 | 0.047 |
| 24 | 1Ag-14Cu-27.96NiO-57.04$Fe_2O_3$ | 0.201 | 0.15 | 0.06 | 0.123 |
| 25 | 1Ag-14Cu-5ZnO-28.08NiO-56.92$Fe_2O_3$ | 0.208 | 0.22 | 0.05 | 0.08 |
| 26 | 1Ag-14Cu-27.96NiO-57.04$Fe_2O_3$ | 0.201 | 0.18 | 0.03 | 0.08 |
| 27 | 1Ag-14Cu-5ZnO-28.08NiO-56.92$Fe_2O_3$ | 0.252 | 0.21 | 0.05 | 0.08 |
| 28 | 1Ag-14Cu-27.96NiO-57.04$Fe_2O_3$ | 0.203 | 0.21 | 0.057 | 0.123 |
| 29 | 1Ag-14Cu-27.35NiO-55.95$Fe_2O_3$_1.7ZnO | 0.251 | 0.12 | 0.03 | 0.043 |
| 30 | 1Ag-14Cu-27.96NiO-57.04$Fe_2O_3$ | 0.238 | 0.12 | 0.05 | 0.184 |
| 31 | 1Ag-14Cu-27.96NiO-57.04$Fe_2O_3$ | 0.221 | 0.185 | 0.048 | 0.157 |
| 32 | 1Ag-14Cu-27.35NiO-55.95$Fe_2O_3$-1.7ZnO | 0.256 | 0.16 | 0.019 | 0.028 |
| 33 | lPd-15Cu-40.48$Fe_2$O3-43.32NiO-0.2ZnO | 0.149 | 0.11 | 0.01 | 0.024 |
| 34 | 1Ag-14Cu-27.96NiO-57.04$Fe_2O_3$ | 0.241 | 0.186 | 0.05 | 0.22 |
| 35 | 3Pd-14Cu-42.91NiO-40.09$Fe_2O_3$ | 0.107 | 0.2 | 0.02 | 0.11 |
| 36 | 1Pt-15Cu-57.12$Fe_2O_3$-26.88NiO | 0.105 | 0.14 | 0.024 | 0.041 |
| 37 | 1Pd-15Cu-57$Fe_2O_3$-27.8NiO-0.2ZnO | 0.279 | 0.115 | 0.014 | 0.023 |
| 38 | 1Pd-15Cu-40.48$Fe_2O_3$-43.32NiO-0.2ZnO | 0.191 | 0.116 | 0.031 | 0.038 |
| 39 | 1Pd-15Cu-40.48$Fe_2O_3$-43.32NiO-0.2ZnO | 0.253 | 0.115 | 0.07 | 0.085 |
| 40 | 0.5Pd-16Cu-43.27NiO-40.43$Fe_2O_3$-0.2ZnO | 0.129 | 0.096 | 0.042 | 0.06 |
| 41 | 0.5Pd-16Cu-43.27NiO-40.43$Fe_2O_3$-0.2ZnO | 0.137 | 0.113 | 0.033 | 0.084 |
| 42 | 0.1Pd-0.9Ag-15Cu-43.32NiO-40.48$Fe_2O_3$-0.2ZnO | | 0.18 | 0.04 | 0.066 |
| 43 | 0.05Pd-0.95Ag-14Cu-27.9NiO-56.9$Fe_2O_3$-0.2ZnO | 0.184 | 0.038 | 0.013 | 0.025 |
| 44 | 0.1Pd-0.9Ag-14Cu-27.9NiO-56.9$Fe_2O_3$-0.2ZnO | 0.148 | 0.18 | 0.025 | 0.05 |
| 45 | 0.1Pd-0.9Ag-14Cu-27.35NiO-55.95$Fe_2O_3$-1.7ZnO | 0.142 | 0.09 | 0.02 | 0.03 |
| 46 | 0.05Pd-0.95Ag-14Cu-27.35NiO-55.95$Fe_2O_3$-1.7ZnO | 0.160 | 0.35 | 0.052 | 0.084 |

TABLE 7-continued

| Sample No. | Composition | Porosity | Fe | Cu | Ni |
|---|---|---|---|---|---|
| 47 | 1Ru-14Cu-27.35NiO-55.95$Fe_2O_3$-1.7ZnO | 0.215 | 0.27 | 0.047 | 0.081 |
| 48 | 0.1Pd-0.9Ag-14Cu-55.81$Fe_2O_3$-27.49NiO- 1.7ZnO | 0.222 | 0.31 | 0.096 | 0.18 |
| 49 | 1.86Ag(as $Ag_2O$)-14.02Cu-27.21NiO-55.23$Fe_2O_3$-1.68ZnO | 0.147 | 0.15 | 0.008 | 0.027 |
| 50 | 0.1Pd-2.7Ag(as $Ag_2O$)-14.02Cu-26.9NiO-54.6$Fe_2O_3$-1.66ZnO | 0.180 | 0.17 | 0.03 | 0.049 |
| 51 | 0.1Pd-0.9Ag(as $Ag_2O$)-14Cu-25.49NiO-55.81 $Fe_2O_3$-1.7ZnO | 0.203 | 0.2 | 0.05 | 0.03 |
| 52 | 1.86Ag(as $Ag_2O$)-14.02Cu-27.21 NiO-55.23$Fe_2O_3$-1.68ZnO | 0.279 | 0.27 | 0.06 | 0.36 |
| 53 | 0.1Pd-0.9Ag(as $Ag_2O$)-14Cu-25.49NiO-55.81$Fe_2O_3$-1.7ZnO | 0.179 | 0.07 | 0.023 | 0.02 |
| 54 | 1.86Ag(as $Ag_2O$)-14.02Cu-27.21NiO-55.23$Fe_2O_3$-1.68ZnO | 0.321 | 0.15 | 0.05 | 0.028 |
| 55 | 1.86Ag(as $Ag_2O$)-14.02Cu-27.21NiO-55.23$Fe_2O_3$-1.68ZnO | 0.212 | 0.19 | 0.02 | 0.075 |
| 56 | 1.86Ag(as $Ag_2O$)-14.02Cu-27.21NiO-55.23$Fe_2O_3$-1.68ZnO | 0.194 | 0.13 | 0.01 | 0.02 |
| 57 | 1.0Ag(as $Ag_2O$)-14Cu(as CuO)-27.5 NiO-55.8$Fe_2O_3$-1.7ZnO | 0.202 | 0.12 | 0.023 | 0.03 |
| 58 | 1.86Ag(as $Ag_2O$)-14.02Cu-27.21NiO-55.23$Fe_2O_3$-1.68ZnO | 0.241 | 0.10 | 0.01 | 0.02 |
| 59 | 1.86Ag(as $Ag_2O$)-14.02Cu-27.21 NiO-55.23 $Fe_2O_3$-1.68 ZnO | | 0.070 | 0.005 | 0.007 |
| 60 | 1.86Ag(as $Ag_2O$)-14.02Cu-27.21 NiO-55.23 $Fe_2O_3$-1.68 ZnO | | 0.054 | 0.005 | 0.008 |
| 61 | 1.86Ag(as $Ag_2O$)-14.02Cu-27.21 NiO-55.23 $Fe_2O_3$-1.68 Zn0 | | 0.191 | 0.05 | 0.060 |
| 62 | 1.86Ag(as $Ag_2O$)-14.02Cu-27.21 NiO-55.23 $Fe_2O_3$-1.68 ZnO | | 0.120 | 0.016 | 0.030 |
| 63 | 1.86Ag(as $Ag_2O$)-14.02Cu-27.21 NiO-55.23 $Fe_2O_3$-1.68 ZnO | | 0.110 | 0.011 | 0.033 |
| 64 | 1.86Ag(as $Ag_2O$)-14.02Cu-27.21 NiO-55.23 $Fe_2O_3$-1.68 ZnO | | 0.221 | 0.039 | 0.080 |
| 65 | 1.86Ag(as $Ag_2O$)-14.02Cu-27.21 NiO-55.23 $Fe_2O_3$-1.68 ZnO | | 0.131 | 0.015 | 0.032 |
| 66 | 1.86Ag(as $Ag_2O$)-14.02Cu-27.21 NiO-55.23 $Fe_2O_3$-1.68 ZnO | | 0.089 | 0.006 | 0.014 |
| 67 | 1.86Ag(as $Ag_2O$)-14.02Cu-27.21 NiO*-55.23 $Fe_2O_3$-1.68 ZnO | | 0.100 | 0.017 | 0.014 |
| 68 | 1.86Ag(as $Ag_2O$)-14.02Cu-27.21 NiO*-55.23 $Fe_2O_3$-1.68 ZnO | | 0.141 | 0.036 | 0.057 |
| 69 | 1.86Ag(as $Ag_2O$)-7.01Cu(as CuO)-7.01Cu-27.2 NiO-55.24 $Fe_2O_3$-1.68 ZnO | | 0.830 | 0.019 | 0.017 |
| 70 | 1.86Ag(as $Ag_2O$)-14.02Cu-27.21 NiO*-55.23 $Fe_2O_3$-1.68 ZnO | | 0.075 | 0.014 | 0.025 |
| 71 | 1.86Ag(as $Ag_2O$)-14.02Cu-27.21 NiO*-55.23 $Fe_2O_3$-1.68 ZnO | | 0.067 | 0.012 | 0.033 |
| 72 | 1.86Ag(as $Ag_2O$)-14.02Cu-27.21 NiO-55.23 $Fe_2O_3$-1.68 ZnO | | 0.073 | 0.007 | 0.017 |
| 73 | 1.86Ag(as $Ag_2O$)-14.02Cu-27.21 NiO-55.23 $Fe_2O_3$-1.68 ZnQ | | 0.121 | 0.038 | 0.071 |
| 74 | 1.86Ag(as $Ag_2O$)-14.02Cu-27.21 NiO*-55.23 $Fe_2O_3$-1.68 ZnO | | 0.086 | 0.016 | 0.028 |
| 75 | 1.86Ag(as $Ag_2O$)-14.02Cu-27.21 NiO*-55.23 $Fe_2O_3$-1.68 ZnO | | 0.094 | 0.043 | 0.060 |
| 76 | 1.86Ag(as $Ag_2O$)-7.01Cu(as CuO)-7.01Cu-27.2 NiO-55.24 $Fe_2O_3$-1.68 ZnO | | 0.063 | 0.044 | 0.027 |
| 77 | 1.86Ag(as $Ag_2O$)-14.02Cu-27.21 NiO-55.23 $Fe_2O_3$-1.68 ZnO | | 0.101 | 0.019 | 0.032 |
| 78 | 1.86Ag(as $Ag_2O$)-14.02Cu-27.21 NiO-55.23 $Fe_2O_3$-1.68 ZnO | | 0.085 | 0.017 | 0.027 |
| 79 | 1.86Ag(as $Ag_2O$)-14.02Cu-27.21 NiO-55.23 $Fe_2O_3$-1.68 ZnO | | 0.089 | 0.026 | 0.051 |
| 80 | 1.86Ag(as $Ag_2O$)-14.02Cu-27.21 NiO-55.23 $Fe_2O_3$-1.68 ZnO | | 0.071 | 0.016 | 0.027 |
| 81 | 1.86Ag(as $Ag_2O$)-14.02Cu-27.21 NiO-55.23 $Fe_2O_3$-1.68 ZnO | | 0.086 | 0.044 | 0.058 |
| 82 | 1.86Ag(as $Ag_2O$)-7.01Cu(as CuO)-7.01Cu-27.2 NiO-55.24 $Fe_2O_3$-1.68 ZnO | | 0.064 | 0.040 | 0.016 |
| 83 | 1.86Ag(as $Ag_2O$)-7.01Cu(as CuO)-7.01Cu-27.2 NiO-55.24 $Fe_2O_3$-1.68 ZnO | | 0.084 | 0.116 | 0.172 |
| 84 | 1.86Ag(as $Ag_2O$)-3.52Cu(as CuO)-10.5Cu-27.2 NiO-55.24 $Fe_2O_3$-1.68 ZnO | | 0.063 | 0.027 | 0.028 |
| 85 | 1.86Ag(as $Ag_2O$)-3.52Cu(as CuO)-10.5Cu-27.2 NiO-55.24 $Fe_2O_3$-1.68 ZnO | | 0.223 | 0.094 | 0.122 |
| 86 | 1.86Ag(as $Ag_2O$)-3.52Cu(as CuO)-10.5Cu-27.2 NiO-55.24 $Fe_2O_3$-1.68 ZnO | | 0.150 | 0.031 | 0.042 |
| 87 | 1.86Ag(as $Ag_2O$)-3.52Cu(as CuO)-10.5Cu-27.2 NiO-55.24 $Fe_2O_3$-1.68 ZnO | | 0.090 | 0.022 | 0.025 |
| 88 | 1.86Ag(as $Ag_2O$)-3.52Cu(as CuO)-10.5Cu-27.2 NiO-55.24 $Fe_2O_3$-1.68 ZnO | | 0.068 | 0.023 | 0.029 |
| 89 | 1.86Ag(as $Ag_2O$)-3.52Cu(as CuO)-10.5Cu-27.2 NiO-55.24 $Fe_2O_3$-1.68 ZnO | | 0.216 | 0.545 | 0.089 |
| 90 | 1.86Ag(as $Ag_2O$)-3.52Cu(as CuO)-10.5Cu-27.2 NiO-55.24 $Fe_2O_3$-1.68 ZnO | | 0.213 | 0.122 | 0.168 |
| 91 | 1.86Ag(as $Ag_2O$)-3.52Cu(as CuO)-10.5Cu-27.2 NiO-55.24 $Fe_2O_3$-1.68 ZnO | | 0.064 | 0.023 | 0.018 |
| 92 | 1.86Ag(as $Ag_2O$)-3.52Cu(as CuO)-10.5Cu-27.2 NiO-55.24 $Fe_2O_3$-1.68 ZnO | | 0.082 | 0.033 | 0.033 |
| 93 | 1.86Ag(as $Ag_2O$)-3.52Cu(as CuO)-10.5Cu-27.2 NiO-55.24 $Fe_2O_3$-1.68 ZnO | | 0.173 | 0.112 | 0.122 |
| 94 | 1.86Ag(as $Ag_2O$)-3.52Cu(as CuO)-10.5Cu-27.2 NiO-55.24 $Fe_2O_3$-1.68 ZnO | | 0.132 | 0.052 | 0.070 |
| 95 | 1.86Ag(as $Ag_2O$)-3.52Cu(as CuO)-10.5Cu-27.2 NiO-55.24 $Fe_2O_3$-1.68 ZnO | | 0.142 | 0.098 | 0.089 |
| 96 | 1.86Ag(as $Ag_2O$)-3.52Cu(as CuO)-10.5Cu-27.2 NiO-55.24 $Fe_2O_3$-1.68 ZnO | | 0.100 | 0.023 | 0.017 |
| 97 | 1.86Ag(as $Ag_2O$)-3.52Cu(as CuO)-10.5Cu-27.2 NiO-55.24 $Fe_2O_3$-1.68 ZnO | | 0.072 | 0.021 | 0.019 |
| 98 | 1.86Ag(as $Ag_2O$)-3.52Cu(as CuO)-10.5Cu-27.2 NiO-55.24 $Fe_2O_3$-1.68 ZnO | | 0.198 | 0.021 | 0.117 |
| 99 | 1.86Ag(as $Ag_2O$)-3.52Cu(as CuO)-10.5Cu-27.2 NiO-55.24 $Fe_2O_3$-1.68 ZnO | | 0.092 | 0.065 | 0.065 |
| 100 | 1.86Ag(as $Ag_2O$)-3.52Cu(as CuO)-10.5Cu-27.2 NiO-55.24 $Fe_2O_3$-1.68 ZnO | | 0.131 | 0.044 | 0.045 |
| 101 | 1.86Ag(as $Ag_2O$)-14.02Cu-27.21 NiO-55.23 $Fe_2O_3$-1.68 ZnO | | 0.288 | 0.031 | 0.124 |
| 102 | 1.86Ag(as $Ag_2O$)-14.02Cu-27.21 NiO-55.23 $Fe_2O_3$-1.68 ZnO | | 0.104 | 0.033 | 0.037 |
| 103 | 1.86Ag(as $Ag_2O$)-3.52Cu(as CuO)-10.5Cu-27.2 NiO-55.24 $Fe_2O_3$-1.68 ZnO | | 0.092 | 0.019 | 0.030 |
| 104 | 1.86Ag(as $Ag_2O$)-3.52Cu(as CuO)-10.5Cu-27.2 NiO-55.24 $Fe_2O_3$-1.68 ZnO | | 0.121 | 0.048 | 0.057 |
| 105 | 1.86Ag(as $Ag_2O$)-14.02Cu-27.21 NiO-55.23 $Fe_2O_3$-1.68 ZnO | | 0.121 | 0.021 | 0.035 |
| 106 | 1.86Ag(as $Ag_2O$)-3.52Cu(as $Cu_2O$)-10.5Cu-27.2 NiO-55.24 $Fe_2O_3$-1.68 ZnO | | 0.151 | 0.056 | 0.082 |
| 107 | 1.86Ag(as $Ag_2O$)-7.01Cu(as $Cu_2O$)-7.01Cu-27.2 NiO-55.24 $Fe_2O_3$-1.68 ZnO | | 0.253 | 0.081 | 0.092 |
| 108 | 1.86Ag(as $Ag_2O$)-14.02Cu-27.21 NiO-55.23 $Fe_2O_3$-1.68 ZnO | | 0.071 | 0.035 | 0.032 |
| 109 | 1.86Ag(as $Ag_2O$)-3.52Cu(as $Cu_2O$)-10.5Cu-27.2 NiO-55.24 $Fe_2O_3$-1.68 ZnO | | 0.071 | 0.035 | 0.032 |
| 110 | 1.86Ag(as $Ag_2O$)-3.52Cu(as $Cu_2O$)-10.5Cu-27.2 NiO-55.24 $Fe_2O_3$-1.68 ZnO | | 0.131 | 0.045 | 0.039 |
| 111 | 1.86Ag(as $Ag_2O$)-3.52Cu(as $Cu_2O$)-10.5Cu-27.2 NiO-55.24 $Fe_2O_3$-1.68 ZnO | | 0.233 | 0.060 | 0.089 |
| 112 | 1.86Ag(as $Ag_2O$)-3.52Cu(as $Cu_2O$)-10.5Cu-27.2 NiO-55.24 $Fe_2O_3$-1.68 ZnO | | 0.111 | 0.036 | 0.365 |
| 113 | 1.86Ag(as $Ag_2O$)-14.02Cu-27.21 NiO-55.23 $Fe_2O_3$-1.68 ZnO | | 0.264 | 0.193 | 0.284 |
| 114 | 1.86Ag(as $Ag_2O$)-14.02Cu-27.21 NiO-55.23 $Fe_2O_3$-1.68 ZnO | | 0.055 | 0.007 | 0.016 |

The results in Table 7 show low levels of aluminum contamination by the cermet inert anodes. In addition, the inert anode wear rate was extremely low in each sample tested. Optimization of processing parameters and cell operation may further improve the purity of aluminum produced in accordance with the invention.

Inert anodes are particularly useful in electrolytic cells for aluminum production operated at temperatures in the range of about 800–1,000° C. A particularly preferred cell operates at a temperature of about 900–980° C., preferably about 930–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

While the invention has been described in terms of preferred embodiments, various changes, additions and modifications may be made without departing from the scope of the invention as set forth in the following claims.

What is claimed is:

1. A cermet inert anode composition for use in a molten salt bath comprising:

a ceramic phase comprising nickel, iron and zinc oxide, wherein the amounts of nickel, iron and zinc in the ceramic phase correspond to the following mole fractions of NiO, $Fe_2O_3$ and ZnO: 0.2 to 0.99 NiO; 0.0001 to 0.8 $Fe_2O_3$; and 0.0001 to 0.3 ZnO, and a metal phase.

2. The cermet inert anode composition of claim 1, wherein the ceramic phase comprises from about 50 to about 95 weight percent of the cermet and the metal phase comprises from about 5 to about 50 weight percent of the cermet.

3. The cermet inert anode composition of claim 1, wherein the ceramic phase comprises from about 80 to about 90 weight percent of the cermet and the metal phase comprises from about 10 to about 20 weight percent of the cermet.

4. The cermet inert anode composition of claim 1, wherein the ceramic phase further comprises an oxide of Co, Cr and/or Al.

5. The cermet inert anode co position of claim 1, wherein the ceramic phase has a Hall cell bath solubility of less than 0.1 weight percent total dissolved oxides.

6. The cermet inert anode co position of claim 1, wherein the ceramic phase has a Hall cell bath solubility of less than 0.08 weight percent total dissolved oxides.

7. The cermet inert anode composition of claim 1, wherein the ceramic phase has a Hall cell bath solubility of less than 0.075 weight percent total dissolved oxides.

8. The cermet inert anode composition of claim 1, wherein the ceramic phase has a Hall cell bath solubility of less than 0.03 weight percent NiO.

9. The cermet inert anode composition of claim 1, wherein the ceramic phase has a Hall cell bath solubility of less than 0.025 weight percent NiO.

10. The cermet inert anode composition of claim 1, wherein the metal phase comprises at least one metal selected from Cu, Ag, Pd, Pt, Au, Rh, Ru, Ir and Os.

11. The cermet inert anode composition of claim 10, wherein the metal phase consists essentially of Cu, Ag, Pd, Pt or combinations thereof.

12. The cermet inert anode composition of claim 1, wherein the metal phase comprises at least one base metal selected from the group consisting of Cu and Ag, and at least one noble metal selected from the group consisting of Ag, Pd, Pt, Au, Rh, Ru, Ir and Os.

13. The cermet inert anode composition of claim 12, wherein the base metal comprises Cu, and the at least one noble metal comprises Ag, Pd, Pt, Au, Rh or a combination thereof.

14. The cermet inert anode composition of claim 13, wherein the at least one noble metal comprises Ag.

15. The cermet inert anode composition of claim 14, wherein the Ag comprises less than about 15 weight percent of the metal phase.

16. The cermet inert anode composition of claim 14, wherein the Ag comprises less than about 10 weight percent of the metal phase.

17. The cermet inert anode composition of claim 14, wherein the Ag comprises from about 0.2 to about 9 weight percent of the metal phase.

18. The cermet inert anode composition of claim 14, wherein the metal phase has a melting point of greater than 800° C.

19. The cermet inert anode composition of claim 13, wherein the at least one noble metal comprises Pd.

20. The cermet inert anode composition of claim 19, wherein the Pd comprises less than about 20 weight percent of the metal phase.

21. The cermet inert anode composition of claim 19, wherein the Pd comprises from about 0.1 to about 10 weight percent of the metal phase.

22. The cermet inert anode composition of claim 13, wherein the at least one noble metal comprises Ag and Pd.

23. The cermet inert anode composition of claim 22, wherein the Ag comprises from about 0.5 to about 30 weight percent of the metal phase, and the Pd comprises from about 0.01 to about 10 weight percent of the metal phase.

24. The cermet inert anode composition of claim 12, wherein the base metal comprises Ag and the at least one noble metal comprises Pd, Pt, Au, Rh or a combination thereof.

25. The cermet inert anode composition of claim 24, wherein the noble metal comprises Pd.

26. The cermet inert anode composition of claim 1, wherein the metal phase has a melting point of greater than about 800° C.

27. The cermet inert anode composition of claim 1, wherein the metal phase has a melting point of greater than about 900° C.

28. The cermet inert anode composition of claim 1, wherein the metal phase has a melting point of greater than about 1,000° C.

29. The cermet inert anode composition of claim 1, wherein the mole fraction of NiO is from 0.45 to 0.8, the mole fraction of $Fe_2O_3$ is from 0.05 to 0.499, and the mole fraction of ZnO is from 0.001 to 0.26.

30. The cermet inert anode composition of claim 1, wherein the mole fraction of NiO is from 0.45 to 0.65, the mole fraction of $Fe_2O_3$ is from 0.2 to 0.49, and the mole fraction of ZnO is from 0.001 to 0.22.

31. The cermet inert anode composition of claim 1, wherein the mole fraction of ZnO is from 0.05 to 0.30.

32. A method of making a cermet inert anode composition, the method comprising:

mixing a metal and a ceramic material comprising nickel, iron and zinc oxide, wherein the amounts of nickel, iron and zinc in the composition correspond to the following mole fractions of NiO, $Fe_2O_3$ and ZnO: 0.2 to 0.99 NiO; 0.0001 to 0.8 $Fe_2O_3$; 0.0001 to 0.3 ZnO;

pressing the metal and ceramic mixture; and sintering the mixture to form the cermet inert anode composition comprising a metal phase and a ceramic phase.

33. The method of claim 32, wherein the ceramic material further comprises an oxide of Co, Cr and/or Al.

34. The method of claim 32, wherein the metal phase comprises at least one metal selected from Cu, Ag, Pd, Pt, Au, Rh, Ru, Ir and Os.

35. The method of claim 32, wherein the metal phase comprises at least one base metal selected from the group consisting of Cu and Ag, and at least one noble metal selected from the group consisting of Ag, Pd, Pt, Au, Rh, Ru, Ir and Os.

36. The method of claim 35, wherein the base metal comprises Cu, and the at least one noble metal comprises Ag, Pd, Pt, Au, Rh or a combination thereof.

37. The method of claim 36, wherein the at least one noble metal comprises Ag.

38. The method of claim 32, wherein the metal phase is provided at least partially from an oxide of the metal.

39. The method of claim 38, wherein the oxide of the metal comprises silver oxide.

40. The method of claim 38, wherein the oxide of the metal comprises copper oxide.

41. The method of claim 32, wherein the mole fraction of NiO is from 0.45 to 0.8, the mole fraction of $Fe_2O_3$ is from 0.05 to 0.499, and the mole fraction of ZnO is from 0.001 to 0.26.

42. The method of claim 32, wherein the mole fraction of NiO is from 0.45 to 0.65, the mole fraction of $Fe_2O_3$ is from 0.2 to 0.49, and the mole fraction of ZnO is from 0.001 to 0.22.

43. The method of claim 32, wherein the mole fraction of ZnO is from 0.05 to 0.30.

44. An electrolytic cell for producing metal comprising;

a molten salt bath comprising an electrolyte and an oxide of a metal to be collected;

a cathode; and a cermet inert anode comprising a metal phase and a ceramic phase comprising nickel, iron and zinc oxide, wherein the amounts of nickel, iron and zinc in the composition correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

45. The electrolytic cell of claim 44, wherein the ceramic phase further comprises an oxide of Co, Cr and/or Al.

46. The electrolytic cell of claim 44, wherein the metal phase comprises at least one metal selected from Cu, Ag, Pd, Pt, Au, Rh, Ru, Ir and Os.

47. The electrolytic cell of claim 44, wherein the metal phase comprises at least one base metal selected from the group consisting of Cu and Ag, and at least one noble metal selected from the group consisting of Ag, Pd, Pt Au, Rh, Ru, Ir and Os.

48. The electrolytic cell of claim 47, wherein the base metal comprises Cu, and the at least one noble metal comprises Ag, Pd, Pt, Au. Rh or a combination thereof.

49. The electrolytic cell of claim 48, wherein the at least one noble metal comprises Ag.

50. The electrolytic cell of claim 44, wherein the mole fraction of NiO is from 0.45 to 0.8, the mole fraction of $Fe_2O_3$ is from 0.05 to 0.499, and the mole fraction of ZnO is from 0.001 to 0.26.

51. The electrolytic cell of claim 44, wherein the mole fraction of NiO is from 0.45 to 0.65, the mole fraction of $Fe_2O_3$ is from 0.2 to 0.49, and the mole fraction of ZnO is from 0.001 to 0.22.

52. The electrolytic cell of claim 44, wherein the mole fraction of ZnO is from 0.05 to 0.30.

53. A method of producing commercial purity aluminum comprising:

passing current between a cermet inert anode and a cathode through a bath comprising an electrolyte and aluminum oxide; and recovering aluminum comprising a maximum of 0.20 weight percent Fe, 0.1 weight percent Cu, and 0.034 weight percent Ni, wherein the cermet inert anode comprises a metal phase and a ceramic phase comprising nickel, iron and zinc oxide, wherein the amounts of nickel, iron and zinc in the composition correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

54. The method of claim 53, wherein the recovered aluminum comprises a maximum of 0.15 weight percent Fe, 0.034 weight percent Cu, and 0.03 weight percent Ni.

55. The method of claim 53, wherein the recovered aluminum comprises a maximum of 0.13 weight percent Fe, 0.03 weight percent Cu, and 0.03 weight percent Ni.

56. The method of claim 53, wherein the recovered aluminum further comprises a maximum of 0.2 weight percent Si, 0.03 weight percent Zn, and 0.03 weight percent Co.

57. The method of claim 53, wherein the recovered aluminum comprises a maximum of 0.10 weight percent of the total of the Cu, Ni and Co.

58. The method of claim 53, wherein the ceramic phase further comprises an oxide of Co, Cr and/or Al.

59. The method of claim 53, wherein the metal phase comprises at least one metal selected from Cu, Ag, Pd, Pt, Au, Rh, Ru, Ir and Os.

60. The method of claim 53, wherein the metal phase comprises at least one base metal selected from the group consisting of Cu and Ag, and at least one noble metal selected from the group consisting of Ag, Pd, Pt, Au, Rh, Ru, Ir and Os.

61. The method of claim 60, wherein the base metal comprises Cu, and the at least one noble metal comprises Ag, Pd, Pt, Au, Rh or a combination thereof.

62. The method of claim 61, wherein the at least one noble metal comprises Ag.

63. The method of claim 53, wherein the mole fraction of NiO is from 0.45 to 0.8, the mole fraction of $Fe_2O_3$ is from 0.05 to 0.499, and the mole fraction of ZnO is from 0.001 to 0.26.

64. The method of claim 53, wherein the mole fraction of NiO is from 0.45 to 0.65, the mole fraction of $Fe_2O_3$ is from 0.2 to 0.49, and the mole fraction of ZnO is from 0.001 to 0.22.

65. The method of claim 53, wherein the mole fraction of ZnO is from 0.05 to 0.30.

66. A cermet inert anode composition for use in a molten salt bath comprising:

a ceramic phase comprising nickel, iron and cobalt oxide, wherein the amounts of nickel, iron and cobalt in the ceramic phase correspond to the following mole fractions of NiO, $Fe_2O_3$ and CoO: 0.25 to 0.55 NiO; 0.45 to 0.55 $Fe_2O_3$; and 0.001 to 0.2 CoO; and a metal phase.

67. The cermet inert anode composition of claim 66, wherein the ceramic phase comprises from about 50 to about 95 weight percent of the cermet, and the metal phase comprises from about 5 to about 50 weight percent of the cermet.

68. The cermet inert anode composition of claim 66, wherein the mole fraction of NiO is about 0.35, the mole fraction of $Fe_2O_3$ is about 0.5, and the mole fraction of CoO is about 0.15.

69. The cermet inert anode composition of claim 66, wherein the ceramic phase further comprises an oxide of Zn, Cr and/or Al.

70. The comet inert anode composition of claim 66, wherein the ceramic phase has a Hall cell bath solubility of less than 0.1 weight percent total dissolved oxides.

71. The cermet inert anode composition of claim 66, wherein the metal phase comprises at least one metal selected from Cu, Ag, Pd, Pt, Au, Rh, Ru, Ir and Os.

72. The cermet inert anode composition of claim 66, wherein the metal phase comprises at least one base metal selected from the group consisting of Cu and Ag, and at least one noble metal selected from the group consisting of Ag, Pd, Pt, Au, Rh, Ru, Ir and Os.

73. A method of making a cermet inert anode composition, the method comprising:

mixing a metal and a ceramic material comprising nickel, iron and cobalt oxide, wherein the amounts of nickel, iron and zinc in the composition correspond to the following mole fractions of NiO, $Fe_2O_3$ and CoO: 0.25 to 0.55 NiO; 0.45 to 0.55 $Fe_2O_3$; and 0.001 to 0.2 CoO;

pressing the metal and ceramic mixture; and sintering the mixture to form the cermet inert anode composition comprising a metal phase and a ceramic phase.

74. The method of claim 73, wherein the ceramic phase comprises from about 50 to about 95 weight percent of the cermet, and the metal phase comprises from about 5 to about 50 weight percent of the cermet.

75. The method of claim 73, wherein the mole fraction of NiO is about 0.35, the mole fraction of $Fe_2O_3$ is about 0.5, and the mole fraction of CoO is about 0.15.

76. The method of claim 73, wherein the ceramic phase further comprises an oxide of Zn, Cr and/or Al.

77. The method of claim 73 wherein the ceramic phase has a Hall cell bath solubility of less than 0.1 weight percent total dissolved oxides.

78. The method of claim 73, wherein the metal phase comprises at least one metal selected from Cu, Ag, Pd, Pt, Au, Rh, Ru, Ir and Os.

79. The method of claim 73, wherein the metal phase comprises at least one base metal selected from the group consisting of Cu and Ag, and at least one noble metal selected from the group consisting of Ag, Pd, Pt, Au, Rh, Ru. Ir and Os.

80. An electrolytic cell for producing metal comprising:

a molten salt bath comprising an electrolyte and an oxide of a metal to be collected;

a cathode; and a cermet inert anode comprising:

a ceramic phase comprising nickel, iron and cobalt oxide, wherein the amounts of nickel, iron and cobalt in the ceramic phase correspond to the following mole fractions of NiO, $Fe_2O_3$ and CoO: 0.25 to 0.55 NiO; 0.45 to 0.55 $Fe_2O_3$; and 0.001 to 0.2 CoO; and a metal phase.

81. The electrolytic cell of claim 80, wherein the ceramic phase comprises from about 50 to about 95 weight percent of the cermet, and the metal phase comprises from about 5 to about 50 weight percent of the cermet.

82. The electrolytic cell of claim 80, wherein the mole fraction of NiO is about 0.35, the mole fraction of $Fe_2O_3$ is about 0.5, and the mole fraction of CoO is about 0.15.

83. The electrolytic cell of claim 80, wherein the ceramic phase further comprise an oxide of Zn, Cr and/or Al.

84. The electrolytic cell of claim 80, wherein the ceramic phase has a Hall cell bath solubility of less than 0.1 weight percent total dissolved oxides.

85. The electrolytic cell of claim 80, wherein the metal phase comprises at least one metal selected from Cu, Ag, Pd, Pt, Au, Rh, Ru, Ir and Os.

86. The electrolytic cell of claim 80, wherein the metal phase comprises at least one base metal selected from the group consisting of Cu and Ag, and at least one noble metal selected from the group consisting of Ag, Pd, Pt, Au, Rh, Ru, Ir and Os.

87. A method of producing commercial purity aluminum comprising:

passing current between a cermet inert anode and a cathode through a bath comprising an electrolyte and aluminum oxide; and recovering aluminum comprising a maximum of 0.20 weight percent Fe, 0.1 weight percent Cu, and 0.034 weight percent Ni, wherein the cermet inert anode comprises a metal phase and a ceramic phase comprising nickel, iron and cobalt oxide, and the amounts of nickel, iron and cobalt in the ceramic phase correspond to the following mole fractions of NiO, $Fe_2O_3$ and CoO: 0.25 to 0.55 NiO; 0.45 to 0.55 $Fe_2O_3$; and 0.001 to 0.2 CoO.

88. The method of claim 87, wherein the ceramic phase comprises from about 50 to about 95 weight percent of the cermet, and the metal phase comprises from about 5 to about 50 weight percent of the cermet.

89. The method of claim 87, wherein the mole fraction of NiO is about 0.35, the mole fraction of $Pe_2O_3$ is about 0.5, and the mole fraction of CoO is about 0.15.

90. The method of claim 87, wherein the ceramic phase further comprises an oxide of Zn, Cr and/or Al.

91. The method of claim 87, wherein the ceramic phase has a Hall cell bath solubility of less than 0.1 weight percent total dissolved oxides.

92. The method of claim 87, wherein the metal phase comprises at least one metal selected from Cu, Ag, Pd, Pt, Au, Rh, Ru, Ir and Os.

93. The method of claim 87, wherein the metal phase comprises at least one base metal selected from the group consisting of Cu land Ag, and at least one noble metal selected from the group consisting of Ag, Pd, Pt, Au, Rh, Ru, Ir and Os.

94. A cermet inert anode composition for use in a molten salt bath comprising:

a ceramic phase; and a metal phase comprising at least one base metal selected from the group consisting of Cu and Ag, and at 1least one noble metal selected from the group consisting of Ag, Pd, Pt, Au, Rh, Ru, Ir and Os.

95. The cermet inert anode composition of claim 94, wherein the ceramic phase comprises from about 50 to about 95 weight percent of the cermet, and the metal phase comprises from about 5 to about 50 weight percent of the cermet.

96. The cermet inert anode composition of claim 94, wherein the ceramic phase comprises from about 80 to about 90 weight percent of the cermet, and the metal phase comprises from about 10 to about 20 weight percent of the cermet.

97. The cermet inert anode composition of claim 94, wherein the base metal comprises Cu, and the at least one noble metal comprises Ag, Pd, Pt, Au, Rh or a combination thereof.

98. The cermet inert anode composition of claim 97, wherein the at least one noble metal comprises Ag.

99. The cermet inert anode composition of claim 98, wherein the Ag comprises less than about 15 weight percent of the metal phase.

100. The cermet inert anode composition of claim 98, wherein the Ag comprises less than about 10 weight percent of the metal phase.

101. The cermet inert anode composition of claim 97, wherein the at least one noble metal comprises Pd.

102. The cermet inert anode composition of claim 97, wherein the at least one noble metal comprises Ag and Pd.

103. The cermet inert anode composition of claim 94, wherein the ceramic phase comprises nickel, iron and zinc oxide, and the amounts of nickel, iron and zinc in the ceramic phase correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

104. The cermet inert anode composition of claim 94, wherein the ceramic phase comprises nickel, iron and cobalt oxide, and the amounts of nickel, iron and cobalt in the ceramic phase correspond to the following mole fractions of NiO, $Fe_2O_3$ and CoO: 0.25 to 0.55 NiO; 0.45 to 0.55 $Fe_2O_3$; and 0.001 to 0.2 CoO.

105. A method of making a cermet inert anode composition, the method comprising:

mixing a ceramic and a metal comprising at least one base metal selected from the group consisting of Cu and Ag, and at least one noble metal selected from the group consisting of Ag, Pd, Pt, Au, Rh, Ru, Ir and Os;

pressing the ceramic and metal mixture; and sintering the mixture to form the cermet inert anode composition comprising a ceramic phase and a metal phase.

106. The method of claim 105, wherein the ceramic phase comprises from about 50 to about 95 weight percent of the cermet, and the metal phase comprises from about 5 to about 50 weight percent of the cermet.

107. The method of claim 105, wherein the ceramic phase comprises from about 80 to about 90 weight percent of the cermet, and the metal phase comprises from about 10 to about 20 weight percent of the cermet.

108. The method of claim 105, wherein the base metal comprises Cu, and the at least one noble metal comprises Ag, Pd, Pt, Au, Rh or a combination thereof.

109. The method of claim 108, wherein the at least one noble metal comprises Ag.

110. The method of claim 109, wherein the Ag comprises less than about 15 weight percent of the metal phase.

111. The method of claim 109, wherein the Ag comprises less than about 10 weight percent of the metal phase.

112. The method of claim 108, wherein the at least one noble metal comprises Pd.

113. The method of claim 108, wherein the at least one noble metal comprises Ag and Pd.

114. The method of claim 105, wherein the ceramic phase comprises nickel, iron and zinc oxide, and the amounts of nickel iron and zinc in the ceramic phase correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

115. The method of claim 105, wherein the ceramic phase comprises nickel, iron and cobalt oxide, and the amounts of nickel, iron rand cobalt in the ceramic phase correspond to the following mole fractions of NiO, $Fe_2O_3$ and, CoO: 0.25 to 0.55 NiO; 0.45 to 0.55 $Fe_2O_3$; and 0.001 to 0.2 CoO.

116. The method of claim 105, wherein at least a portion of the metal phase is provided from an oxide of the metal.

117. An electrolytic cell for producing metal comprising:

a molten salt bath comprising an electrolyte and an oxide of a metal to be collected;

a cathode; and a cermet inert anode comprising a ceramic phase and a metal phase comprising at least one base metal selected from the group consisting of Cu and Ag, and at least one noble metal selected from the,group consisting of Ag, Pd, Pt, Au, Rh, Ru, Ir and Os.

118. The electrolytic cell of claim 117, wherein the ceramic phase comprises from about 50 to about 95 weight percent of the cermet, and the metal phase comprises from about 5 to about 50 weight percent of the cermet.

119. The electrolytic cell of claim 117, wherein the ceramic phase comprises from about 80 to about 90 weight percent of the cermet, and the metal phase comprises from about 10 to about 20 weight percent of the cermet.

120. The electrolytic cell of claim 117, wherein the base metal comprises Cu, and the at least one noble metal comprises Ag, Pd, Pt, Au, Rh or a combination thereof.

121. The electrolytic cell of claim 120, wherein the at least one noble metal comprises Ag.

122. The electrolytic cell of claim 121, wherein the Ag comprises less than about 15 weight percent of the metal phase.

123. The electrolytic cell of claim 121, wherein the Ag comprises less than about 10 weight percent of the metal phase.

124. The electrolytic cell of claim 120, wherein the at least one noble metal comprises Pd.

125. The electrolytic cell of claim 120, wherein the at least one noble metal comprises Ag and Pd.

126. The electrolytic cell of claim 117, wherein the ceramic phase comprises nickel, iron and zinc oxide, and the amounts of nickel, iron and zinc in the ceramic phase correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

127. The electrolytic cell of claim 117, wherein the ceramic phase comprises nickel, iron and cobalt oxide, and the amounts of nickel, iron and cobalt in the ceramic phase correspond to the following mole fractions of NiO, $Fe_2O_3$ and CoO: 0.25 to 0.55 NiO; 0.45 to 0.55 $Fe_{23}$ and 0.001 to 0.2 CoO.

128. A method of producing commercial purity aluminum comprising:

passing current between a cermet inert anode and a cathode through a bath comprising an electrolyte and aluminum oxide; and recovering aluminum comprising a maximum of 0.20 weight percent Fe, 0.1 weight percent Cu, and 0.034 weight percent Ni, wherein the cermet inert anode comprises a ceramic phase and a metal phase comprising at least one base metal selected from the group consisting of Cu and Ag, and at least one noble metal selected from the group consisting of Ag, Pd, Pt, Au, Rh, Ru, Ir and Os.

129. The method of claim 128, wherein the ceramic phase comprises from about 50 to about 95 weight percent of the cermet, and the metal phase comprises from about 5 to about 50 weight percent of the cermet.

130. The method of claim 128, wherein the ceramic phase comprises from about 80 to about 90 weight percent of the cermet, and the metal phase comprises from about 10 to about 20 weight percent of the cermet.

131. The method of claim 128, wherein the base metal comprises Cu, and the at least one noble metal comprises Ag, Pd, Pt, Au Rh or a combination thereof.

132. The method of claim 131, wherein the at least one noble metal comprises Ag.

133. The method of claim 132, wherein the Ag comprises less than about 15 weight percent of the metal phase.

134. The method of claim 132, wherein the Ag comprises less than about 10 weight percent of the metal phase.

135. The method of claim 131, wherein the at least one noble metal comprises Pd.

136. The method of claim 131, wherein the at least one noble metal comprises Ag and Pd.

137. The method of claim 128, wherein the ceramic phase comprises nickel, iron and zinc oxide, and the amounts of nickel, iron and zinc in the ceramic phase correspond to the following mole fractions of NiO, $Fe_2O_3$ and ZnO: 0.2 to 0.99 NiO; 0.0001 to 0.8 $Fe_2O_3$; and 0.0001 to 0.3 ZnO.

138. The method of claim 128 wherein the ceramic phase comprises nickel, iron and cobalt oxide, and the amounts of nickel, iron and cobalt in the ceramic phase correspond to the following mole fractions of NiO, $Fe_2O_3$ and CoO: 0.25 to 0.55 NiO; 0.45 to 0.55 $Fe_2O$; and 0.001 to 0.2 CoO.

* * * * *